US009645530B2

(12) United States Patent
Kochi et al.

(10) Patent No.: US 9,645,530 B2
(45) Date of Patent: May 9, 2017

(54) IMAGE FORMING APPARATUS

(71) Applicants: Naoto Kochi, Kanagawa (JP); Kenji Sugiura, Kanagawa (JP); Hirokazu Ishii, Tokyo (JP); Hiroyoshi Haga, Kanagawa (JP); Yuuji Wada, Kanagawa (JP); Takehide Mizutani, Tokyo (JP); Naohiro Kumagai, Kanagawa (JP); Junpei Fujita, Kanagawa (JP); Tatsuya Ohsugi, Kanagawa (JP); Kazuki Yogosawa, Kanagawa (JP)

(72) Inventors: Naoto Kochi, Kanagawa (JP); Kenji Sugiura, Kanagawa (JP); Hirokazu Ishii, Tokyo (JP); Hiroyoshi Haga, Kanagawa (JP); Yuuji Wada, Kanagawa (JP); Takehide Mizutani, Tokyo (JP); Naohiro Kumagai, Kanagawa (JP); Junpei Fujita, Kanagawa (JP); Tatsuya Ohsugi, Kanagawa (JP); Kazuki Yogosawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/142,424

(22) Filed: Apr. 29, 2016

(65) Prior Publication Data

US 2016/0334738 A1 Nov. 17, 2016

(30) Foreign Application Priority Data

May 15, 2015 (JP) ..... 2015-100424

(51) Int. Cl.
*G03G 15/16* (2006.01)

(52) U.S. Cl.
CPC ..... *G03G 15/163* (2013.01); *G03G 15/1605* (2013.01); *G03G 15/1675* (2013.01); *G03G 2215/0129* (2013.01)

(58) Field of Classification Search
None
See application file for complete search history.

(56) References Cited

U.S. PATENT DOCUMENTS 4,728,991 A * 3/1988 Takayama ..... G03G 15/1645 271/307
5,631,725 A 5/1997 Harasawa et al.
(Continued)

FOREIGN PATENT DOCUMENTS

JP 9-106192 4/1997
JP 11-153917 6/1999
(Continued)

OTHER PUBLICATIONS

U.S. Appl. No. 14/956,707, filed Dec. 2, 2015.
(Continued)

*Primary Examiner* — Sevan A Aydin
(74) *Attorney, Agent, or Firm* — Oblon, McClelland, Maier & Neustadt, L.L.P.

(57) ABSTRACT

An image forming apparatus includes an image bearer, a transfer device contacting the image bearer to form a transfer portion, a transfer bias power source, and a controller. A ratio of a time period of application of the opposite-directional bias to a total time period of one cycle of the AC component of the superimposed bias is greater than 50%. A ratio of a value of the DC component of the superimposed bias output within a region ranging from a leading end of the recording medium to a predetermined length to a value of the DC component of the superimposed bias output outside the region is greater than a ratio of a value of the AC component of the superimposed bias output within the
(Continued)

| CORRECTION COEFFICIENT OF TRANSFER CURRENT AT LEADING END PORTION [%] | | IMAGE DENSITY ON LEADING END SIDE |
|---|---|---|
| AC | DC | |
| 100 | 100 | POOR |
| 120 | 100 | POOR |
| 120 | 120 | POOR |
| 100 | 120 | GOOD |

region to a value of the AC component of the superimposed bias output outside the region.

10 Claims, 19 Drawing Sheets

(56) References Cited

U.S. PATENT DOCUMENTS

| | | | | |
|---|---|---|---|---|
| 5,689,758 | A * | 11/1997 | Wataki | G03G 15/16 399/314 |
| 5,822,667 | A | 10/1998 | Hayama et al. | |
| 6,282,386 | B1 | 8/2001 | Ishii | |
| 6,731,890 | B1 * | 5/2004 | Rakov | G03G 15/1675 399/299 |
| 2003/0035658 | A1 | 2/2003 | Ishii | |
| 2006/0098999 | A1 * | 5/2006 | Nishida | G03G 15/065 399/55 |
| 2007/0127941 | A1 | 6/2007 | Ishii et al. | |
| 2010/0008687 | A1 | 1/2010 | Ishii | |
| 2010/0080586 | A1 * | 4/2010 | Booth | G03G 21/203 399/44 |
| 2010/0329707 | A1 * | 12/2010 | Yamada | G03G 15/161 399/44 |
| 2012/0045237 | A1 * | 2/2012 | Aoki | G03G 15/1675 399/66 |
| 2012/0237271 | A1 * | 9/2012 | Sengoku | G03G 15/161 399/296 |
| 2012/0308250 | A1 | 12/2012 | Shimizu et al. | |
| 2012/0315058 | A1 | 12/2012 | Shimizu et al. | |
| 2012/0328321 | A1 | 12/2012 | Takeuchi et al. | |
| 2013/0004190 | A1 | 1/2013 | Sengoku et al. | |
| 2013/0011155 | A1 * | 1/2013 | Ogiyama | G03G 15/0189 399/66 |
| 2013/0136468 | A1 | 5/2013 | Shimizu et al. | |
| 2013/0136477 | A1 | 5/2013 | Ogiyama et al. | |
| 2013/0164011 | A1 | 6/2013 | Nakamura et al. | |
| 2013/0236201 | A1 | 9/2013 | Mizutani et al. | |
| 2013/0308968 | A1 | 11/2013 | Tanaka et al. | |
| 2014/0029988 | A1 | 1/2014 | Shimizu et al. | |
| 2014/0079418 | A1 | 3/2014 | Tanaka et al. | |
| 2014/0241744 | A1 | 8/2014 | Ichikawa et al. | |
| 2014/0314435 | A1 | 10/2014 | Kato et al. | |
| 2014/0328603 | A1 | 11/2014 | Mizutani et al. | |
| 2014/0328604 | A1 | 11/2014 | Tanaka et al. | |
| 2015/0212454 | A1 | 7/2015 | Ichikawa et al. | |
| 2015/0378284 | A1 | 12/2015 | Wada et al. | |
| 2016/0033915 | A1 | 2/2016 | Kumagai et al. | |
| 2016/0041508 | A1 | 2/2016 | Kogure et al. | |

FOREIGN PATENT DOCUMENTS

| | | | |
|---|---|---|---|
| JP | 2000242062 | A * | 9/2000 |
| JP | 2005099215 | A * | 4/2005 |
| JP | 2007-101817 | | 4/2007 |
| JP | 2011-013241 | | 1/2011 |
| JP | 2012-063740 | | 3/2012 |
| JP | 2014-232127 | | 12/2014 |

OTHER PUBLICATIONS

U.S. Appl. No. 15/073,983, filed Mar. 18, 2016.
U.S. Appl. No. 14/966,398, filed Dec. 11, 2015.
U.S. Appl. No. 14/969,216, filed Dec. 15, 2015.
U.S. Appl. No. 14/962,062, filed Dec. 8, 2015.
U.S. Appl. No. 15/065,600, filed Mar. 9, 2016.
U.S. Appl. No. 14/822,180, filed Aug. 10, 2015.
U.S. Appl. No. 14/881,611, filed Oct. 13, 2015.

* cited by examiner

FIG. 6

| INTERMEDIATE TRANSFER BELT | PRENIP AMOUNT | PAPER TYPE | SECONDARY TRANSFER CURRENT [−μA] | | | | | |
|---|---|---|---|---|---|---|---|---|
| | | | 60 | 80 | 100 | 120 | 140 | 160 |
| ELASTIC BELT | 0 mm | THIN | POOR | POOR | POOR | POOR | POOR | POOR |
| | | PLAIN | POOR | POOR | POOR | POOR | POOR | POOR |
| | 1 mm | THIN | POOR | POOR | POOR | POOR | POOR | POOR |
| | | PLAIN | GOOD | FAIR | POOR | POOR | POOR | POOR |
| | 2 mm | THIN | GOOD | FAIR | POOR | POOR | POOR | POOR |
| | | PLAIN | GOOD | GOOD | GOOD | POOR | POOR | POOR |
| | 3 mm | THIN | GOOD | GOOD | FAIR | POOR | POOR | POOR |
| | | PLAIN | GOOD | GOOD | GOOD | GOOD | GOOD | FAIR |
| | 4 mm | THIN | GOOD | GOOD | GOOD | GOOD | FAIR | POOR |
| | | PLAIN | GOOD | GOOD | GOOD | GOOD | GOOD | GOOD |
| | 5 mm | THIN | GOOD | GOOD | GOOD | GOOD | GOOD | FAIR |
| | | PLAIN | GOOD | GOOD | GOOD | GOOD | GOOD | GOOD |
| PI BELT | 0 mm | THIN | FAIR | POOR | POOR | POOR | POOR | POOR |
| | | PLAIN | GOOD | FAIR | POOR | POOR | POOR | POOR |
| | 1 mm | THIN | GOOD | GOOD | POOR | POOR | POOR | POOR |
| | | PLAIN | GOOD | GOOD | GOOD | GOOD | POOR | POOR |
| | 2 mm | THIN | GOOD | GOOD | GOOD | GOOD | POOR | POOR |
| | | PLAIN | GOOD | GOOD | GOOD | GOOD | GOOD | GOOD |
| | 3 mm | THIN | GOOD | GOOD | GOOD | GOOD | GOOD | GOOD |
| | | PLAIN | GOOD | GOOD | GOOD | GOOD | GOOD | GOOD |
| | 4 mm | THIN | GOOD | GOOD | GOOD | GOOD | GOOD | GOOD |
| | | PLAIN | GOOD | GOOD | GOOD | GOOD | GOOD | GOOD |
| | 5 mm | THIN | GOOD | GOOD | GOOD | GOOD | GOOD | GOOD |
| | | PLAIN | GOOD | GOOD | GOOD | GOOD | GOOD | GOOD |

| CORRECTION COEFFICIENT OF TRANSFER CURRENT AT LEADING END PORTION [%] | | IMAGE DENSITY ON LEADING END SIDE |
|---|---|---|
| AC | DC | |
| 100 | 100 | POOR |
| 120 | 100 | POOR |
| 120 | 120 | POOR |
| 100 | 120 | GOOD |

| LENGTH FROM LEADING END [mm] | IMAGE DENSITY ON LEADING END SIDE |
|---|---|
| 5 | POOR |
| 10 | FAIR |
| 20 | GOOD |
| 30 | GOOD |

| | CORRECTION COEFFICIENT OF DC AT LEADING END PORTION [%] | | | | | |
|---|---|---|---|---|---|---|
| IMAGE | 100 | 110 | 120 | 130 | 140 | 150 |
| ONE COLOR | GOOD | GOOD | GOOD | FAIR | FAIR | POOR |
| TWO COLORS | FAIR | FAIR | GOOD | GOOD | GOOD | GOOD |
| THREE COLORS | POOR | FAIR | GOOD | GOOD | GOOD | GOOD |

FIG. 20

| BASIS WEIGHT gsm | TRANSFER CURRENT AT IMAGE PORTION [μA] | LENGTH FROM LEADING EDGE [mm] | CORRECTION COEFFICIENT OF TRANSFER CURRENT AT LEADING END PORTION [%] | | | | | |
|---|---|---|---|---|---|---|---|---|
| | | | 23°C 50% | | 27°C 80% | | 10°C 15% | |
| | | | AC | DC | AC | DC | AC | DC |
| 80 | 114 | 20 | 100 | 120 | 100 | 110 | 100 | 140 |
| 100 | 114 | 20 | 100 | 120 | 100 | 120 | 100 | 140 |
| 200 | 114 | 20 | 100 | 120 | 100 | 120 | 100 | 150 |
| 324 | 124 | 30 | 100 | 130 | 100 | 120 | 100 | 160 |
| 351 | 134 | 30 | 100 | 140 | 100 | 130 | 100 | 160 |

IMAGE FORMING APPARATUS

CROSS-REFERENCE TO RELATED APPLICATION

This patent application is based on and claims priority pursuant to 35 U.S.C. §119(a) to Japanese Patent Application No. 2015-100424, filed on May 15, 2015, in the Japan Patent Office, the entire disclosure of which is hereby incorporated by reference herein.

BACKGROUND

Technical Field

Exemplary aspects of the present disclosure generally relate to an image forming apparatus, such as a copier, a facsimile machine, a printer, or a multi-functional system including a combination thereof.

Related Art

In an image forming apparatus that employs an electrophotographic method, a belt-shaped image bearer bearing an image contacts a transfer device opposed to the image bearer to form a transfer nip as a transfer portion, thereby transferring the image onto a recording sheet in the transfer nip. The electrical resistance is high at the leading end portion of the recording sheet passing through the transfer portion because no toner image is transferred onto the leading end portion, unlike at an image portion where the toner image is transferred. Accordingly, the electrical resistance significantly changes while the recording sheets passes the transfer nip. This leads to an insufficient amount of the transfer bias to transfer the toner image onto the leading end portion of the image portion on the recording sheet. Hence, a configuration is proposed, in which a target output value of the transfer bias when it rises is greater than a target output value of the transfer bias applied to the image portion, to prevent a reduction in density on the leading end side of the image portion.

SUMMARY

In an aspect of this disclosure, there is provided an improved image forming apparatus, including an image bearer to bear a toner image; a transfer device contacting the image bearer to form a transfer portion; a transfer bias power source; and a controller. The transfer bias power source outputs a transfer bias to transfer the toner image from the image bearer to a recording medium at the transfer portion. The transfer bias is a superimposed bias including a direct current (DC) component and an alternating current (AC) component that cyclically alternates between a transfer-directional bias to transfer the toner from the image bearer to the recording medium and an opposite-directional bias in an opposite direction of the transfer direction. The controller controls the transfer bias power source to output the transfer bias. A ratio of a time period of application of the opposite-directional bias to a total time period of one cycle of the AC component of the superimposed bias is greater than 50%. A ratio of a value of the DC component of the superimposed bias output within a region ranging from a leading end of the recording medium to a predetermined length to a value of the DC component of the superimposed bias output outside the region is greater than a ratio of a value of the AC component of the superimposed bias output within the region to a value of the AC component of the superimposed bias output outside the region.

BRIEF DESCRIPTION OF THE DRAWINGS

The aforementioned and other aspects, features, and advantages of the present disclosure will be better understood by reference to the following detailed description when considered in connection with the accompanying drawings, wherein:

FIG. 3A is a partially enlarged cross-sectional view of an image bearer formed into an elastic belt including a coating layer; FIG. 3B is a partially enlarged cross-sectional view of an image bearer formed into an elastic belt including particles; FIG. 3C is a partially enlarged view of FIG. 3B as seen from above;

FIG. 6 is a table of evaluation results of prenip electrical discharge with different offset amounts of a transfer device relative to belt-shaped image bearers having different materials;

FIG. 20 is a table of optimal values of the thickness of the recording sheet, environment conditions, the range of length of the recording sheet, and the transfer bias;

Figure 1:
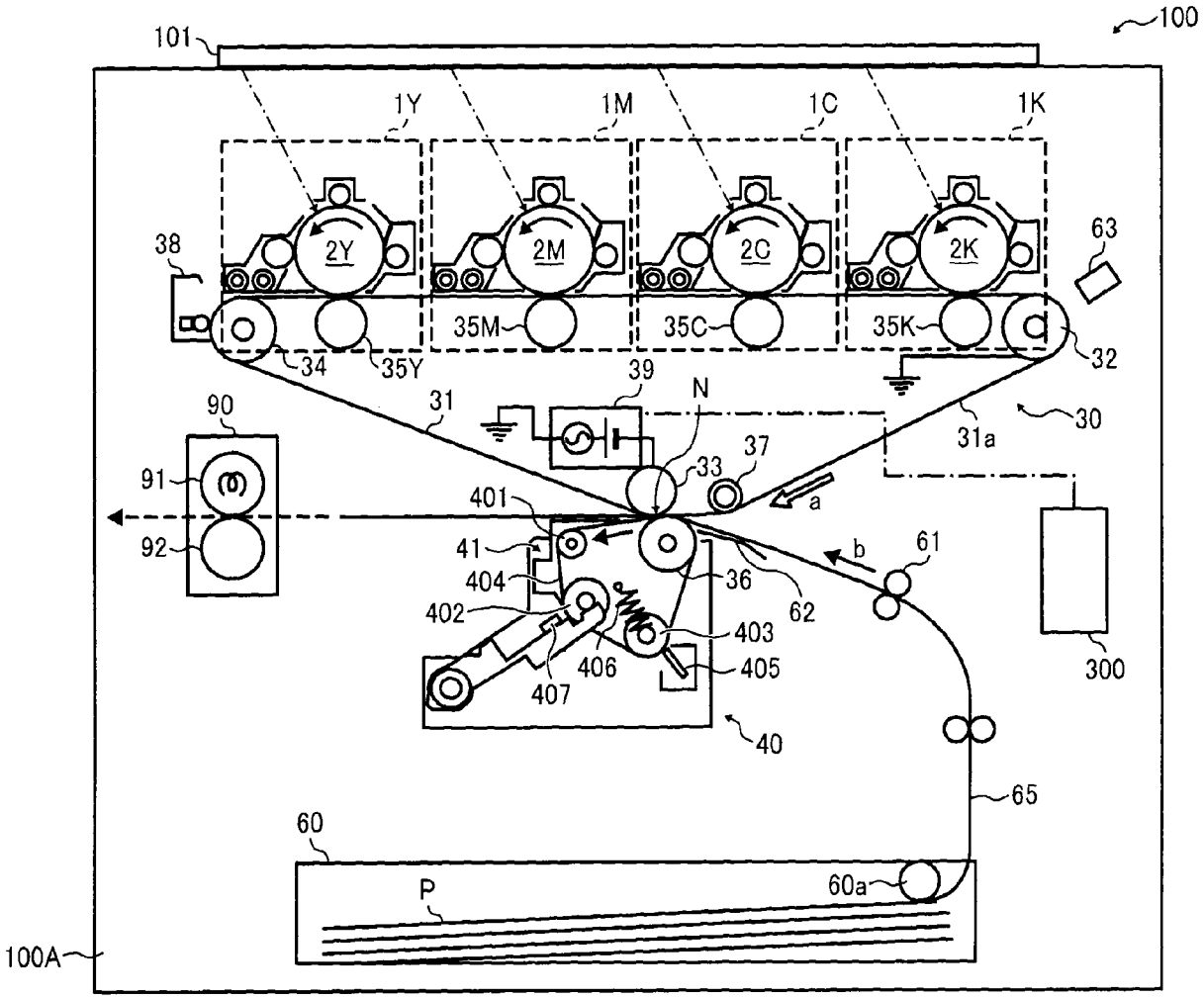
FIG. 1 is a schematic view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

With reference to FIG. 1, a description is provided of the image forming apparatus according to an embodiment of the present disclosure. The same reference numerals will be given to constituent elements such as parts and materials having the same functions, and the descriptions thereof will be omitted. In some Figures, portions of configurations are partially omitted to better understand the configurations. It is to be noted that suffixes Y, M, C, and K denote colors yellow, magenta, cyan, and black, respectively. These suffixes may be omitted unless otherwise specified.

With reference to FIG. 1, a description is provided of an electrophotographic color printer (hereinafter referred to as an image forming apparatus) as an example of an image forming apparatus 100 according to an embodiment of the present disclosure.

A description is provided of a configuration of an image forming apparatus 100, illustrated as an electrophotographic color printer, according to an embodiment of the present disclosure. FIG. 1 is a schematic diagram of the relevant sections of the image forming apparatus 100 according to the present embodiment. As illustrated in FIG. 1, the image forming apparatus 100 includes four image forming units 1Y, 1M, 1C, and 1K for forming toner images, one for each of the colors yellow, magenta, cyan, and black, respectively. It is to be noted that the suffixes Y, M, C, and K denote colors yellow, magenta, cyan, and black, respectively. To simplify the description, the suffixes Y, M, C, and K indicating colors may be omitted herein, unless differentiation of colors is necessary. The image forming apparatus 100 includes a transfer unit 30 as a transfer device, a fixing device 90, a paper cassette 60 to house a recording sheet P as recording medium, and a controller 300.

The image forming units 1Y, 1M, 1C, and 1K all have the same configuration as all the others, except for different colors of toner employed as a powder-form developing agent. The image forming units 1Y, 1M, 1C, and 1K are replaced upon reaching their product life cycles. According to the present embodiment, the image forming units 1Y, 1M, 1C, and 1K are detachably attachable relative to an apparatus body 100A of the image forming apparatus 100 and replaceable.

Figure 2:
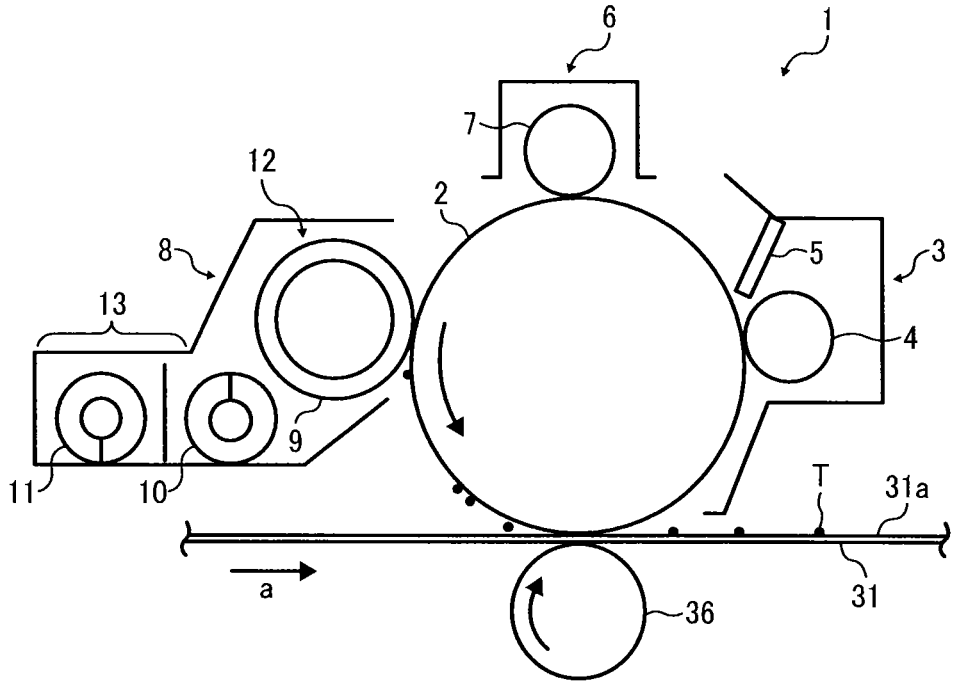
FIG. 2 is a schematic view of an image forming unit employed in the image forming apparatus of FIG. 1.

FIG. 2 is an enlarged diagram of one of the image forming units 1Y, 1M, 1C, and 1K as a representative example. The image forming units 1Y, 1M, 1C, and 1K all have the same configuration as all the others, except for different color of toner employed. Thus, the description is provided without the suffixes Y, M, C, and K indicating colors unless differentiation of the color is necessary.

The image forming unit 1 includes a drum-shaped photoconductor 2 as a latent image bearer, a photoconductor cleaner 3, a static eliminator, a charging device 6, a developing device 8, and so forth. These devices are held in a common casing so that they are detachably installable and replaceable all together relative to the apparatus body 100A, thereby constituting a process cartridge. The image forming unit 1 is replaceable independently.

The photoconductor 2 comprises a drum-shaped base on which an organic photosensitive layer is disposed. The photoconductor 2 is rotated in a clockwise direction indicated by arrow by a driving device such as a motor. The charging device 6 includes a charging roller 7 to which a charging bias is applied. The charging roller 7 contacts or approaches the photoconductor 2 to generate an electrical discharge therebetween, thereby charging uniformly the surface of the photoconductor 2. Instead of using the charging roller 7 or the like that contacts or disposed close to the photoconductor 2, a corona charger or the like that does not contact the photoconductor 2 may be employed.

The uniformly charged surface of the photoconductor 2 by the charging roller 7 is scanned by exposure light such as a light beam projected from the optical writing unit 101, thereby forming an electrostatic latent image for each color on the surface of the photoconductor 2. The electrostatic latent image on the photoconductor 2 is developed with toner of each color by the developing device 8. Accordingly, a visible image, also known as a toner image, is formed. The toner image formed on the photoconductor 2 is transferred primarily onto an intermediate transfer belt 31 as an intermediate transferor formed into an endless loop.

The photoconductor cleaner 3 removes residual toner remaining on the surface of the photoconductor 2 after a primary transfer process, that is, after the photoconductor 2 passes through a primary transfer nip between the intermediate transfer belt 31 and the photoconductor 2. The photoconductor cleaner 3 includes a brush roller 4, which is driven to rotate, and a cleaning blade 5. The cleaning blade 5 contacts the surface of the photoconductor 2. The brush roller 4 rotates and brushes off the residual toner from the surface of the photoconductor 2 while the cleaning blade 5 scraping off the residual toner from the surface. The static eliminator may employ a known static eliminating device and removes residual charge remaining on the photoconductor 2 after the surface thereof is cleaned by the photoconductor cleaner 3. The surface of the photoconductor 2 is initialized in preparation for the subsequent imaging cycle.

The developing device 8 includes a developing portion 12 and a developer conveyor 13. The developing portion 12 includes a developing roller 9 serving as a developer bearer inside thereof. The developer conveyor 13 stirs and transports the developing agent. The developer conveyor 13 includes a first chamber equipped with a first screw 10 and a second chamber equipped with a second screw 11. The first screw 10 and the second screw 11 are rotatably supported by a casing or the like of the developing device 8. The first screw 10 and the second screw 11 are rotated to deliver the developing agent to the developing roller 9 while circulating the developing agent.

As illustrated in FIG. 1, the optical writing unit 101 for writing a latent image on the photoconductors 2 is disposed above the image forming units 1Y, 1M, 1C, and 1K. Based on image information received from an external device such as a personal computer (PC), the optical writing unit 101 scans optically the photoconductors 2Y, 2M, 2C, and 2K with a light beam projected from a laser diode of the optical writing unit 101. Accordingly, the electrostatic latent images of yellow, magenta, cyan, and black are formed on the photoconductors 2Y, 2M, 2C, and 2K, respectively.

Referring back to FIG. 1, a description is provided of the transfer unit 30. The transfer unit 30 is disposed substantially below the image forming units 1Y, 1M, 1C, and 1K. The transfer unit 30 includes the intermediate transfer belt 31 as an image bearer formed into an endless loop and rotated in the clockwise direction indicated by arrow a in the Figure (that is, a direction a of movement of the belt). A direction of rotation of the intermediate transfer belt 31 is referred to as a direction a of movement of the belt.

The intermediate transfer unit 30 includes a plurality of rollers: a drive roller 32, a secondary-transfer first roller 33, a cleaning auxiliary roller 34, four primary transfer rollers 35Y, 35M, 35C, and 35K (which may be referred to collectively as primary transfer rollers 35), and a pre-transfer roller 37 serving as a depressing device. The primary transfer rollers 35Y, 35M, 35C, and 35K are disposed opposite the photoconductors 2Y, 2M, 2C, and 2K, respectively, via the intermediate transfer belt 31. The transfer unit 30 is detachably attachable (replaceable) relative to the apparatus body 100A.

The intermediate transfer belt 31 is wound around and stretched taut between the plurality of rollers. i.e., the drive roller 32, the secondary-transfer first roller 33, the cleaning auxiliary roller 34, the four primary transfer rollers 35Y, 35M, 35C, and 35K, and the pre-transfer roller 37. The drive roller 32 is rotated in the clockwise direction by a motor or the like, and rotation of the drive roller 32 enables the intermediate transfer belt 31 to rotate in the same direction. In the transfer unit 30, the intermediate transfer belt 31 is wound around the plurality of rollers, thereby delivering the recording sheet P.

The intermediate transfer belt 31 according to the present embodiment is an endless looped belt having at least a base layer 310, an elastic layer 311, and a surface coating layer 312. In some embodiments, a belt including a laminate of the base layer 310 and the elastic layer 311 with a large numbers of particles 313 dispersed in the elastic layer 311 can be used as the intermediate transfer belt 31, as illustrated in FIG. 3B. While a portion of the particles 313 projects from the elastic layer 311, the particles 313 are arranged concentratedly in a belt surface direction as illustrated in FIG. 3C. With these particles 313, an uneven surface of the belt with multiple bumps is formed on the front surface 31 a of the intermediate transfer belt 31.

Figure 3A:
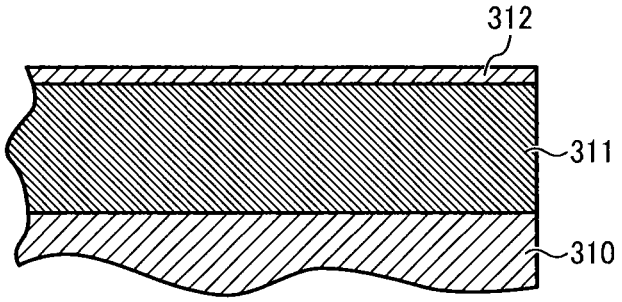
FIGS. 3A, 3B, and 3C are views of an image bearer formed into an endless loop.
Figure 3B:
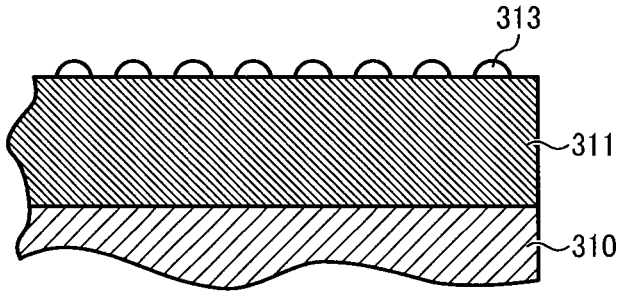
Figure 3C:
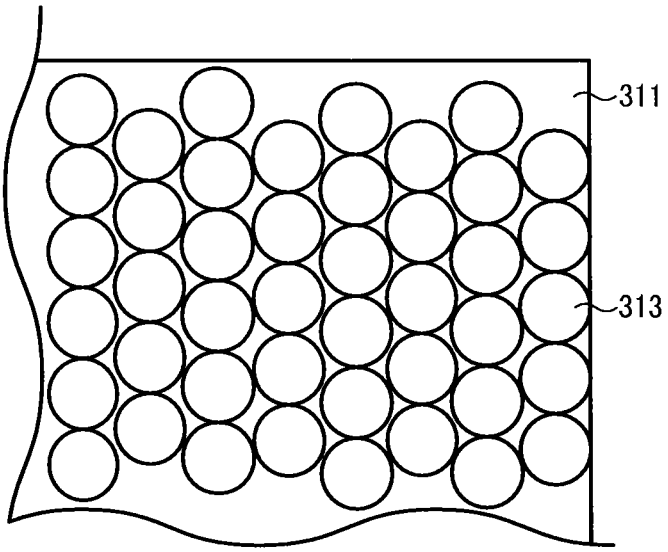

As illustrated in FIGS. 3A and B, the intermediate transfer belt 31 includes the base layer 310 and the elastic layer 311. The base layer 310 formed into an endless looped belt is formed of a material having a high stiffness, but having some flexibility. The elastic layer 311 disposed on the front surface of the base layer 310 is formed of an elastic material with high elasticity.

Examples of materials for the base layer 310 include, but are not limited to, a resin in which an electrical resistance adjusting material made of a filler or an additive is dispersed to adjust electrical resistance. Examples of the resin constituting the base layer 310 include, but are not limited to, fluorine-based resins such as ethylene tetrafluoroethylene copolymers (ETFE) and polyvinylidene fluoride (PVDF), and polyimide resins or polyamide-imide resins in terms of flame retardancy. In terms of mechanical strength (high elasticity) and heat resistance, specifically, polyimide resins or polyamide-imide resins are more preferable.

Examples of the electrical resistance adjusting materials dispersed in the resin include, but are not limited to, metal oxides, carbon blacks, ion conductive materials, and conductive polymers. Examples of metal oxides include, but are not limited to, zinc oxide, tin oxide, titanium oxide, zirconium oxide, aluminum oxide, and silicon oxide. In order to enhance dispersiveness, surface treatment may be applied to metal oxides in advance. Examples of carbon blacks include, but are not limited to, ketchen black, furnace black, acetylene black, thermal black, and gas black. Examples of ion conductive materials include, but are not limited to, tetraalkylammonium salt, trialkyl benzyl ammonium salt, alkylsulfonate, and alkylbenzene sulfonate. Examples of ion conductive materials include, but are not limited to, tetraalkylammonium salt, trialkyl benzyl ammonium salt, alkylsulfonate, alkylbenzene sulfonate, alkylsulfate, glycerol esters of fatty acid, sorbitan fatty acid ester, polyoxyethylene alkylamine, polyoxyethylene aliphatic alcohol ester, alkylbetaine, and lithium perchlorate. Two or more ion conductive materials can be mixed. It is to be noted that electrical resistance adjusting materials are not limited to the above-mentioned materials.

A dispersion auxiliary agent, a reinforcing material, a lubricating material, a heat conduction material, an antioxidant, and so forth may be added to a coating liquid which is a precursor for the base layer 310, as needed. The coating solution is a liquid resin before curing in which electrical resistance adjusting materials are dispersed. An amount of the electrical resistance adjusting materials to be dispersed in the base layer 310 of a seamless belt, i.e., the intermediate transfer belt 31 is preferably in a range from $1\times10^{8}$ to $1\times10^{13}$ Ω/sq in surface resistivity, and in a range from $1\times10^{6}$ to $10^{12}$ Ω•cm in volume resistivity. In terms of mechanical strength, an amount of the electrical resistance adjusting material to be added is determined such that the formed film is not fragile and does not crack easily. Preferably, a coating liquid, in which a mixture of the resin component (for example, a polyimide resin precursor and a polyamide-imide resin precursor) and the electrical resistance adjusting material are adjusted properly, is used to manufacture a seamless belt (i.e., the intermediate transfer belt) in which the electrical characteristics (i.e., the surface resistivity and the volume resistivity) and the mechanical strength are well balanced. The content of the electrical resistance adjusting material in the coating liquid when using carbon black is in a range from 10% through 25% by weight or preferably, from 15% through 20% by weight relative to the solid content. The content of the electrical resistance adjusting material in the coating liquid when using metal oxides is approximately 150% by weight or more preferably, in a range from 10% through 30% by weight relative to the solid content. If the content of the electrical resistance adjusting material is less than the above-described respective range, a desired effect is not achieved. If the content of the electrical resistance adjusting material is greater than the above-described respective range, the mechanical strength of the intermediate transfer belt (seamless belt) 31 drops, which is undesirable in actual use.

The thickness of the base layer 310 is not limited to a particular thickness and can be selected as needed. The thickness of the base layer 310 is preferably in a range from 30 μm to 150 μm, more preferably in a range from 40 μm to 120 μm, even more preferably, in a range from 50 μm to 80 μm. The base layer 310 having a thickness of less than 30 μm cracks and gets torn easily. The base layer 310 having a thickness of greater than 150 μm cracks when it is bent. By contrast, if the thickness of the base layer 310 is in the above-described respective range, the durability is enhanced.

In order to increase the stability of traveling of the intermediate transfer belt 31, preferably, the thickness of the base layer 310 is uniform as much as possible. An adjustment method to adjust the thickness of the base layer 310 is not limited to a particular method, and can be selected as needed. For example, the thickness of the base layer 310 can be measured using a contact-type or an eddy-current thickness meter or a scanning electron microscope (SEM) which measures a cross-section of the film.

As described above, the elastic layer 311 of the intermediate transfer belt 31 includes an uneven surface formed with the particles 313 dispersed in the elastic layer 311. Examples of elastic materials for the elastic layer 311 include, but are not limited to, generally-used resins, elastomers, and rubbers. Preferably, elastic materials having good elasticity such as elastomer materials and rubber materials are used. Examples of the elastomer materials include, but are not limited to, polyesters, polyamides, polyethers, polyurethanes, polyolefins, polystyrenes, polyacrylics, polydiens, silicone-modified polycarbonates, and thermoplastic elastomers such as fluorine-containing copolymers. Alternatively, thermoplastic elastomer, such as fluorine-based copolymer thermoplastic elastomer, may be employed. Examples of thermosetting resins include, but are not limited to, polyurethane resins, silicone-modified epoxy resins, and silicone modified acrylic resins. Examples of rubber materials include, but are not limited to isoprene rubbers, styrene rubbers, butadiene rubbers, nitrile rubbers, ethylene-propylene rubbers, butyl rubbers, silicone rubbers, chloroprene rubbers, and acrylic rubbers. Examples of rubber materials include, but are not limited to, chlorosulfonated polyethylenes, fluorocarbon rubbers, urethane rubbers, and hydrin rubbers. A material having desired characteristics can be selected from the above-described materials. In particular, in order to accommodate a recording sheet with an uneven surface such as Leathac (registered trademark), soft materials are preferable. Because the particles 313 are dispersed, thermosetting materials are more preferable than thermoplastic materials. The thermosetting materials have a good adhesion property relative to resin particles due to an effect of a functional group contributing to the curing reaction, thereby fixating reliably. For the same reason, vulcanized rubbers are also preferable.

In terms of ozone resistance, softness, adhesion properties relative to the particles, application of flame retardancy, environmental stability, and so forth, acrylic rubbers are most preferable among elastic materials for forming the elastic layer 311. Acrylic rubbers are not limited to a specific product. Commercially-available acrylic rubbers can be used. An acrylic rubber of carboxyl group crosslinking type is preferable since the acrylic rubber of the carboxyl group crosslinking type among other cross linking types (e.g., an epoxy group, an active chlorine group, and a carboxyl group) provides good rubber physical properties (specifically, the compression set) and good workability. Preferably, amine compounds are used as crosslinking agents for the acrylic rubber of the carboxyl group crosslinking type. More preferably, multivalent amine compounds are used. Examples of the amine compounds include, but are not limited to, aliphatic multivalent amine crosslinking agents and aromatic multivalent amine crosslinking agents. Furthermore, examples of the aliphatic multivalent amine crosslinking agents include, but are not limited to, hexamethylenediamine, hexamethylenediamine carbamate, and N,N'-dicinnamylidene-1,6-hexanediamine. Examples of the aromatic multivalent amine crosslinking agents include, but are not limited to, 4,4'-methylenedianiline, m-phenylenediamine, 4,4'-diaminodiphenyl ether, 3,4'-diaminodiphenyl ether, 4,4'-(m-phenylenediisopropylidene) dianiline, 4,4'-(p-phenylenediisopropylidene) dianiline, 2,2'-bis [4-(4-aminophenoxy)phenyl] propane, 4,4'-diaminobenzanilide, 4,4'-bis (4-aminophenoxy)biphenyl, m-xylylenediamine, p-xylylenediamine, 1,3,5-benzenetriamine, and 1,3,5-benzenetriaminomethyl.

The amount of the crosslinking agent is, preferably, in a range from 0.05 through 20 parts by weight, more preferably, from 0.1 through 5 parts by weight, relative to 100 parts by weight of the acrylic rubber. An insufficient amount of the crosslinking agent causes failure in crosslinking, hence complicating efforts to maintain the shape of crosslinked products. By contrast, too much crosslinking agent causes crosslinked products to be too stiff, hence degrading elasticity as a crosslinking rubber.

In order to enhance a cross-linking reaction, a crosslinking promoter may be mixed in the acrylic rubber employed for the elastic layer 311. The type of crosslinking promoter is not limited particularly. However, it is preferable that the crosslinking promoter can be used with the above-described multivalent amine crosslinking agents. Such crosslinking promoters include, but are not limited to, guanidino compounds, imidazole compounds, quaternary onium salts, tertiary phosphine compounds, and weak acid alkali metal salts. Examples of the guanidino compounds include, but are not limited to, 1,3-diphenylguanidine, and 1,3-di-o-tolylguanidine. Examples of the imidazole compounds include, but are not limited to, 2-methylimidazole and 2-phenylimidazole. Examples of the quaternary onium salts include, but are not limited to, tetra-n-butylammonium bromide and octadecyltri-n-butylammonium bromide. Examples of the multivalent tertiary amine compounds include, but are not limited to, triethylenediamine and 1,8-diazabicyclo[5.4.0] undec-7-ene (DBU). Examples of the tertiary phosphines include, but are not limited to, triphenylphosphine and tri(p-tolyl)phosphine. Examples of the weak acid alkali metal salts include, but are not limited to, phosphates such as sodium and potassium, inorganic weak acid salts such as carbonate or stearic acid salt, and organic weak acid salts such as lauric acid salt.

The amount of the crosslinking promoter is, preferably, in a range from 0.1 through 20 parts by weight, more preferably, from 0.3 through 10 parts by weight, relative to 100 parts by weight of the acrylic rubber. Too much crosslinking promoter causes undesirable acceleration of crosslinking during crosslinking, generation of bloom of the crosslinking promoter on the surface of crosslinked products, and hardening of the crosslinked products. By contrast, an insufficient amount of the crosslinking agent causes degradation of the tensile strength of the crosslinked products and a significant elongation change or a significant change in the tensile strength after heat load.

The acrylic rubber composition of the present disclosure can be prepared by an appropriate mixing procedure such as roll mixing, Banbury mixing, screw mixing, and solution mixing. The order in which the ingredients are mixed is not particularly limited. However, it is preferable that ingredients that are not easily reacted or decomposed when heated are first mixed thoroughly, and thereafter, ingredients that are easily reacted or decomposed when heated, such as a crosslinking agent, are mixed together in a short period of time at a temperature at which the crosslinking agent is neither reacted nor decomposed.

When heated, the acrylic rubber serves as a crosslinked product. The heating temperature is preferably in a range of 130° C. through 220° C., more preferably, 140° C. through 200° C. The crosslinking time period is preferably in a range of 30 seconds through 5 hours. The heating methods can be chosen from those which are used for crosslinking rubber compositions, such as press heating, steam heating, oven heating, and hot-air heating. In order to reliably crosslink the inside of the crosslinked product, post crosslinking may be additionally carried out after crosslinking is carried out once. The post crosslinking time period varies depending on the heating method, the crosslinking temperature and the shape of crosslinked product, but is carried out preferably for 1 through 48 hours. The heating method and the heating temperature may be appropriately chosen. Electrical resistance adjusting agents for adjustment of electrical characteristics and flame retardants to achieve flame retardancy may be added to the selected materials. Furthermore, antioxidants, reinforcing agents, fillers, and crosslinking promoters may be added as needed. The electrical resistance adjusting agents to adjust electrical resistance can be selected from the above-described materials. However, since the carbon blacks and the metal oxides impair flexibility, it is preferable to minimize the amount of use. Ion conductive materials and conductive high polymers are also effective. Alternatively, these materials can be used in combination.

Preferably, various types of perchlorates and ionic liquids in an amount from about 0.01 parts by weight through 3 parts by weight are added, based on 100 parts by weight of rubber. With the ion conductive material in an amount 0.01 parts by weight or less, the resistivity cannot be reduced effectively. However, with the ion conductive material in an amount 3 parts by weight or more, it is highly possible that the conductive material blooms or bleeds to the belt surface.

The electrical resistance adjusting material to be added is in such an amount that the surface resistivity of the elastic layer 311 is, preferably, in a range from $1\times10^{8}$ Ω/sq to $1\times10^{13}$ Ω/sq, and the volume resistivity of the elastic layer 311 is, preferably, in a range from $1\times10^{6}$ Ω•cm to $1\times10^{12}$ Ω•cm. In order to obtain high toner transferability relative to an uneven surface of a recording sheet as is desired in image forming apparatuses using electrophotography in recent years, it is preferable to adjust a micro rubber hardness of the elastic layer 311 to 35 or less under the condition 23° C., 50% RH. In measurement of Martens hardness and Vickers hardness, which are a so-called micro-hardness, a shallow area of a measurement target in a bulk direction, that is, the hardness of only a limited area near the surface is measured. Thus, deformation capability of the entire belt cannot be evaluated. Consequently, for example, in a case in which a soft material is used for the uppermost layer of the intermediate transfer belt 31 with a relatively low deformation capability as a whole, the micro-hardness decreases. In such a configuration, the intermediate transfer belt 31 with a low deformation capability does not conform to the surface condition of the uneven surface of the recording sheet, thereby impairing the desired transferability relative to the uneven surface of the recording sheet. In view of the above, preferably, the micro-rubber hardness, which allows the evaluation of the deformation capability of the entire intermediate transfer belt 31, is measured to evaluate the hardness of the intermediate transfer belt 31.

The layer thickness of the elastic layer 311 is, preferably, in a range from 200 μm to 2 mm, more preferably, 400 μm to 1000 μm. The layer thickness less than 200 μm hinders deformation of the belt in accordance with the roughness (surface condition) of the recording sheet and a transfer-pressure reduction effect. By contrast, the layer thickness greater than 2 mm causes the elastic layer 311 to sag easily due to its own weight, resulting in unstable movement of the intermediate transfer belt 31 and damage to the intermediate transfer belt 31 looped around rollers. The layer thickness can be measured by observing the cross-section of the elastic layer 311 using a scanning electron microscope (SEM), for example.

The surface coating layer 312 of the intermediate transfer belt 31 is a smooth layer that covers the surface of the elastic layer 311. Any material can be used for the surface coating layer 312. However, materials that can enhance the transferability of the secondary transfer through reducing the adhesion force of the toner onto the front surface 31*a* of the intermediate transfer belt 31 are generally used. Examples of materials used for the coating layer include, but are not limited to, polyurethane resin, polyester resin, epoxy resin, and combinations of two or more of the above-described materials. Alternatively, a material that reduces surface energy to improve lubricating property, such as fluorocarbon resin grains, fluorine compound grains with or without the grain size being varied may be used alone or in combination. The surface coating layer may also be a fluorine-containing layer formed by thermally treating a fluorine-containing rubber, thereby reducing surface energy of the layer. However, these materials are not limited thereto.

In order to adjust resistance, each of the base layer 310, the elastic layer 311, and the surface coating layer 312 may be formed of metal powder such as carbon black, graphite, aluminum, and nickel, conductive metal oxides, or the like. However, these materials are not limited thereto.

A lubricant may be applied to the front surface 31*a* of the intermediate transfer belt 31 to protect the front surface 31*a* of the intermediate transfer belt 31 depending on the material of the toner and the intermediate transfer belt employed and the surface friction coefficient of the intermediate transfer belt 31. The materials of the lubricant includes zinc stearate. A brush roller of a lubricant applicator contacts and scrapes a block (solid) lubricant such as a block of zinc stearate while rotating. The lubricant in powder form thus obtained is applied to the front surface 31*a* of the intermediate transfer belt 31.

The particle 313 to be dispersed in the elastic material of the elastic layer 311 is a spherical resin particle having an average particle diameter of equal to or less than 100 μm and is insoluble in an organic solvent. Furthermore, the 3% thermal decomposition temperature of these resin particles is equal to or greater than 200° C. The resin material of the particle 313 is not particularly limited, but may include acrylic resins, melamine resins, polyamide resins, polyester resins, silicone resins, fluorocarbon resins, and rubbers. Alternatively, in some embodiments, surface processing with different material is applied to the surface of the particle made of resin materials. A surface of a spherical mother particle made of rubber may be coated with a hard resin. Furthermore, the mother particle may be hollow or porous.

Among such resins mentioned above, the silicone resin particles are most preferred because the silicone resin particles provide good slidability, separability relative to toner, and wear and abrasion resistance. Preferably, the spherical resin particles are prepared through a polymerization process. The more spherical the particle is, the more preferred. Preferably, the volume average particle diameter of the particle is in a range from 1.0 μm to 5.0 μm, and the particle dispersion is monodisperse with a sharp distribution. The monodisperse particle is not a particle with a single particle diameter. The monodisperse particle is a particle having a sharp particle size distribution. More specifically, the distribution width of the particle is equal to or less than ± (Average particle diameter × 0.5 μm). With the particle diameter of the particle 313 less than 1.0 μm, enhancement of transfer performance by the particle 313 cannot be achieved sufficiently. By contrast, with the particle diameter greater than 5.0 μm, the space between the particles increases, which results in an increase in the surface roughness of the intermediate transfer belt 31. In this configuration, toner is not transferred well, and the intermediate transfer belt 31 cannot be cleaned well. In general, the particle 313 made of resin material has a relatively high insulation property. Thus, if the particle diameter is too large, accumulation of electrical charges of the particle diameter 313 during continuous printing causes image defect easily.

Either commercially-available products or laboratory-derived products may be used as the particle 31*c*. The thus-obtained particle 313 is directly applied to the elastic layer 311 and evened out, thereby evenly distributing the particle 313 with ease. With this configuration, an overlap of the particles 313 in the belt thickness direction is reduced, if not prevented entirely. Preferably, the cross-sectional diameter of the plurality of particles 313 in the surface direction of the elastic layer 311 is as uniform as possible. More specifically, the distribution width thereof is equal to or less than ±(Average particle diameter × 0.5 μm). For this reason, preferably, powder including particles with a small particle diameter distribution is used as the particles 313. If the particles 313 having a specific particle diameter can be applied to the elastic layer 311 selectively, it is possible to use particles having a relatively large particle diameter distribution. It is to be noted that timing at which the particles 313 are applied to the surface of the elastic layer 311 is not particularly limited. The particles 313 can be applied before or after crosslinking of the elastic material of the elastic layer 311.

Preferably, a projected area ratio of a portion of the elastic layer 311 having the particles 313 relative to the elastic layer 311 with its surface being exposed is equal to or greater than 60% in the surface direction of the elastic layer 311. In a case in which the projected area ratio is less than 60%, the frequency of direct contact between toner and the pure surface of the elastic layer 311 increases, thereby degrading transferability of toner, cleanability of the belt surface from which toner is removed, and filming resistance. In some embodiments, a belt without the particles 313 dispersed in the elastic layer 311 can be used as the intermediate transfer belt 31.

The intermediate transfer belt 31 is interposed between the primary transfer rollers 35Y, 35M, 35C, and 35K, and photoconductors 2Y, 2M, 2C, and 2K, thereby forming primary transfer nips serving as transfer sections for each color between the front surface or the image bearing surface of the intermediate transfer belt 31 and the photoconductors 2Y, 2M, 2C, and 2K. A primary transfer bias is applied to the primary transfer rollers 35Y, 35M, 35C, and 35K by a well-known transfer bias power source. Accordingly, a primary transfer electric field is formed between the primary transfer rollers 35Y, 35M, 35C, and 35K, and the toner images of yellow, magenta, cyan, and black formed on the photoconductors 2Y, 2M, 2C, and 2K.

An yellow toner image formed on the photoconductor 2Y enters the primary transfer nip for yellow as the photoconductor 2Y rotates. Subsequently, the yellow toner image is primarily transferred from the photoconductor 2Y to the intermediate transfer belt 31 by the transfer electric field and the nip pressure. The intermediate transfer belt 31, on which the yellow toner image has been transferred, passes sequentially through the primary transfer nips of magenta, cyan, and black. Subsequently, a magenta toner image, a cyan toner image, and a black toner image on the photoconductors 2M, 2C, and 2K, respectively, are superimposed on the yellow toner image which has been transferred on the intermediate transfer belt 31, one atop the other in the primary transfer process. Accordingly, a composite toner image, in which the toner images of four different colors are superimposed on one atop the other, is formed on the surface of the intermediate transfer belt 31 in the primary transfer process. According to the present embodiment, roller-type primary transfer devices, that is, the primary transfer rollers 35Y, 35M, 35C, and 35K, are employed as primary transfer devices. Alternatively, a transfer charger and a brush-type transfer device may be employed as the primary transfer device. The present embodiment was described assuming that a full-color image, in which toner images of four different colors are superimposed one atop the other, is formed. Alternatively, a single-color toner image with any one of an yellow toner, a magenta toner, a cyan toner, and a black toner, or a toner image with at least two of these color toner may be formed to be transferred onto the intermediate transfer belt 31 in the primary image forming process.

Outside the loop formed by the intermediate transfer belt 31, a secondary transfer unit 41 is disposed. The secondary transfer unit 41 includes a secondary transfer belt 404 as an image bearer and also as a secondary transfer device. The intermediate transfer belt 31 is interposed between the secondary-transfer first roller 33 and the secondary-transfer second roller 36, thereby forming a secondary transfer nip N at which the front surface 31*a* of the intermediate transfer belt 31 contacts the secondary transfer belt 404. The secondary-transfer first roller 33 is also called an opposed roller opposing the secondary transfer belt 404 via the intermediate transfer belt 31.

A power source 39 as a transfer bias power source applies a secondary transfer bias to the secondary-transfer first roller 33. With this configuration, a secondary-transfer electrical field is formed between the secondary-transfer first roller 33 and the secondary transfer belt 404 so that the toner having a negative polarity is moved electrostatically from the secondary-transfer first roller 33 to the secondary transfer belt 404.

The first support assembly 40 detachably supports the secondary transfer unit 41. The secondary transfer unit 41 is replaceable independently. The secondary transfer unit 41 includes a secondary-transfer second roller 36 serving as a secondary transfer device disposed opposed to the secondary-transfer first roller 33 via the intermediate transfer belt 31. The secondary transfer unit 41 includes three rollers 401, 402, and 403, the secondary-transfer second roller 36, and the secondary transfer belt 404 looped around the three rollers 401, 402, and 403. The secondary transfer unit 41 is a belt conveyor unit in which the secondary transfer belt 404 is an endless looped belt serving as a transfer device, and is looped around the plurality of rollers, i.e., the secondary-transfer second roller 36, and the rollers 401, 402, and 403. The secondary-transfer second roller 36 can also be referred to as a nip forming roller.

The secondary-transfer second roller 36 secondarily transfers the toner image on the front surface 31 a of the intermediate transfer belt 31 onto the recording sheet P. The secondary-transfer second roller 36 is disposed inside the belt loop of the secondary transfer belt 404, opposing the secondary-transfer first roller 33. The intermediate transfer belt 31 and the secondary transfer belt 404 are interposed between the secondary-transfer second roller 36 and the secondary-transfer first roller 33. The secondary-transfer second roller 36 is biased against the secondary transfer belt 404 so as to pressingly contact the intermediate transfer belt 31, thereby forming the secondary transfer nip N between the intermediate transfer belt 31 and the secondary transfer belt 404.

The material for the secondary transfer belt 404 may be selected from resin such as polyimide (PI) resin, polyamide imide (PAI) resin, and polyvinylidene (PVDF) resin. The secondary transfer belt 404 are not limited to those described above, but may employ a belt made of an elastic material. According to the present embodiment, a belt made of polyimide resin (PI), having a thickness of 80 μm is employed.

The roller 401 is to strip the recording sheet P electrostatically absorbed to the secondary transfer belt 404 from the secondary transfer belt 404 by self stripping. The roller 403 serves as a tension roller that presses the secondary transfer belt 404 from the inside of the loop of the secondary transfer belt 404 towards the outside by a tension spring 406 as a biasing device. It is to be noted that a cleaning blade 405 is disposed outside of the loop of the secondary transfer belt 404, contacting the roller 403 to remove toner with a cleaning blade 405 that contacts the front surface (outer circumferential surface) of the secondary transfer belt 404. Hence, the roller 403 serves as a cleaning blade opposed roller disposed opposite the cleaning blade 405.

In the secondary transfer unit 41, a pattern sensor 407 serving as a density detector is disposed outside of the loop of the secondary transfer belt 404, facing the roller 402. The pattern sensor 407 adjusts an image density.

The secondary transfer unit 41 that employs a belt scheme has advantageous effects from the viewpoint of reliably separating the recording sheet P from the intermediate transfer belt 31. This is because a greater attracting force from the secondary transfer belt 404 acts on the recording sheet P than the intermediate transfer belt 31 when the recording sheet P passes through the secondary transfer nip N. Therefore, the image forming device according to the present embodiment that employs the belt scheme accommodate a separation of thin paper as well.

According to the present embodiment, the power source 39 applies a bias for the secondary transfer bias (a secondary transfer bias) to the secondary-transfer first roller 33. Alternatively, the power source 39 applies the secondary transfer bias to the secondary-transfer second roller 36. When the secondary transfer bias is applied to the secondary-transfer second roller 36, the secondary transfer bias applied has a polarity opposite to that of the toner. When the secondary transfer bias is applied to the secondary-transfer first roller 33, the secondary transfer bias applied has the same polarity as that of the toner.

In the present embodiment, the power source 39 outputs the secondary transfer bias to transfer a toner image onto the recording sheet P in the secondary transfer nip N. The secondary transfer bias output from the power source 39 to the secondary-transfer first roller 33 includes two types: a direct current (DC) voltage as a direct current (DC) component and a superimposed bias, in which an alternating current (AC) voltage as an alternating current (AC) component is superimposed on the DC voltage as a DC component.

More particularly, the power source 39 alternates a voltage in a transfer direction (a transfer-directional voltage) to transfer a toner image from the image bearer to the recording sheet and a voltage in a return direction (a return-directional voltage, or an opposite-directional voltage) having a polarity opposite that of the transfer-directional voltage, while supplying a voltage to the secondary-transfer first roller 33 to transfer a toner image at least on the image bearer onto the recording sheet P. In this case, a ratio of a time period for applying the return-directional bias to a total time period of one cycle of the voltage output from the power source 39 is greater than 50%. A description is provided later of the secondary transfer bias according to an embodiment of the present disclosure.

As illustrated in FIG. 1, the paper cassette 60 storing a sheaf of recording sheets P such as various types of paper sheets and resin sheets is disposed below the secondary transfer unit 41. The paper cassette 60 is equipped with a feed roller 60*a* to contact the top sheet of recording sheet P in the paper cassette 60. As the feed roller 60*a* is rotated at a predetermined speed, the feed roller 60*a* picks up and sends the top sheet of the recording sheets P to a delivery path 65 formed between the paper cassette 60 and the secondary transfer nip N. Through the delivery path, a pair of conveyance rollers, a pair of registration rollers 61, and a lower guide 62 is disposed. The pair of registration rollers 61 starts to rotate again to feed the recording sheet P, which has been fed from the paper cassette 60, to the secondary transfer nip N in appropriate timing such that the recording sheet P is aligned with the composite toner image formed on the front surface 31*a* of the intermediate transfer belt 31 in the secondary transfer nip N.

In the secondary transfer nip N, the composite toner image on the intermediate transfer belt 31 is transferred onto the recording sheet P by the secondary transfer electric field and the nip pressure applied thereto in the secondary transfer nip N, thereby forming a full-color image on the front surface 31*a* of the white recording sheet P. After the intermediate transfer belt 31 passes through the secondary transfer nip N, the toner residue not having been transferred onto the recording sheet P remains on the intermediate transfer belt 31. The residual toner is removed from the intermediate transfer belt 31 by the belt cleaner 38 which contacts the front surface 31 a of the intermediate transfer belt 31. The cleaning auxiliary roller 34 disposed inside the loop formed by the intermediate transfer belt 31 supports the cleaning operation performed by the belt cleaner 38.

The fixing device 90 is disposed downstream from the secondary transfer nip N in the direction b of conveyance of the recording sheet P. After the secondary transfer, the recording sheet P, onto which the composite color toner image is transferred, is transported to the fixing device 90. The fixing device 90 includes a fixing roller 91 including a heat source inside thereof and a pressing roller 92. The fixing roller 91 and the pressing roller 92 contact to form the fixing nip where heat and pressure are applied. The composite toner image is softened and fixed on the recording sheet P as the recording sheet P passes through the fixing nip. After the toner image is fixed to the recording sheet P, the recording sheet P is output from the fixing device 90. Subsequently, the recording sheet P is delivered outside the image forming apparatus 100.

According to the present embodiment, a bias (a secondary transfer bias) is applied to the secondary-transfer first roller 33 from the power source 39. According to the present embodiment, the secondary-transfer first roller 33, to which the power source 39 applies a bias, is sometimes called a repulsive roller because a transfer bias having a negative polarity is applied to a negative-charged toner so that the toner applied with the transfer bias is transferred with a repulsive force. The secondary-transfer first roller 33 is a foamed roller, such as a sponge roller. The second transfer bias from the power source 39 may be applied to the secondary-transfer second roller 36 instead of to the secondary-transfer first roller 33.

When the secondary transfer bias is applied to the secondary-transfer second roller 36, the secondary transfer bias applied has a polarity opposite to that of the toner. When the secondary transfer bias is applied to the secondary-transfer first roller 33, the secondary transfer bias applied has the same polarity as that of the toner.

Figure 4A:
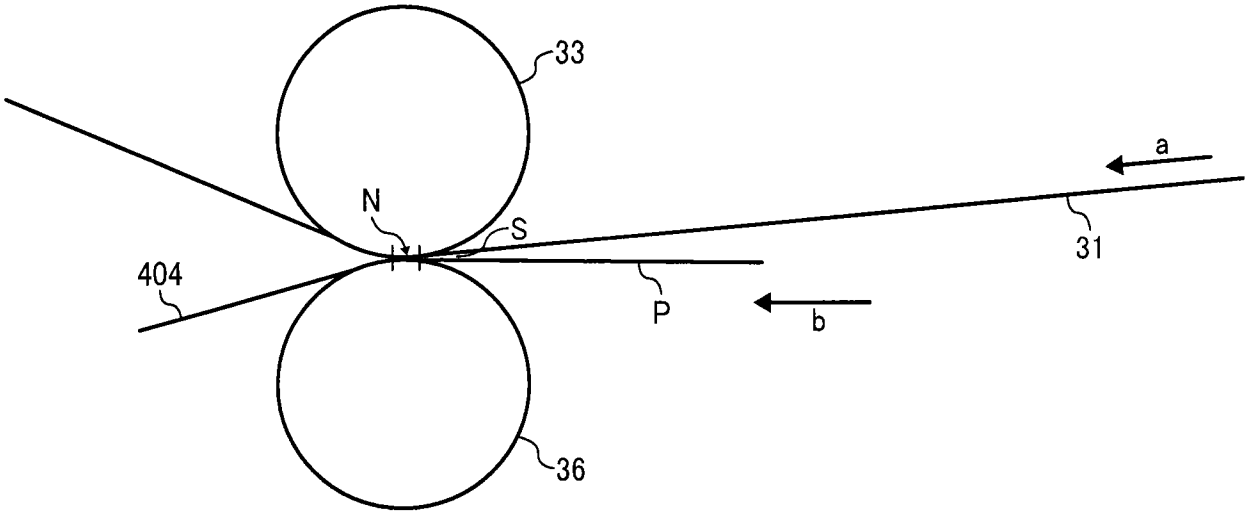
FIGS. 4A and 4B are views of electrical discharge before transfer nip.

While the secondary transfer bias is applied to the secondary-transfer first roller 33, an electrical discharge occurs between the front surface 31 a of the intermediate transfer belt 31 wound around the secondary-transfer first roller 33 and the recording sheet P entering a secondary transfer nip N where the secondary-transfer first roller 33 contacts the secondary-transfer second roller 36. Such an electrical discharge is referred to as a prenip electrical discharge. As illustrated in FIG. 4A, the secondary-transfer second roller 36 is not offset from a position, at which the secondary-transfer second roller 36 faces the secondary-transfer first roller 33, to the upstream side (i.e., the right side) in a direction b of conveyance of the recording sheet. In this case, toward the right side of the entrance of the secondary transfer nip, a space S is formed between the intermediate transfer belt 31 and the recording sheet P, thereby generating the electrical discharge in the space S.

Figure 4B:
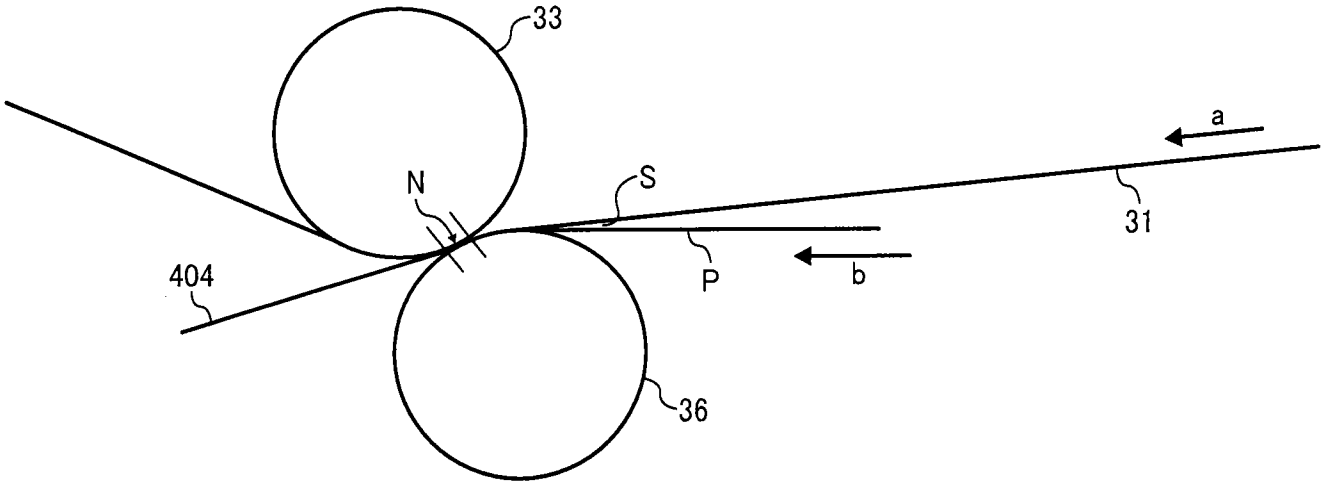

In contrast, referring to FIG. 4B, the secondary-transfer second roller 36 is offset to the upstream side in the direction b of conveyance of the recording sheet. In this case, the recording sheet P comes into contact with the intermediate transfer belt 31 before the recording sheet P enters the secondary transfer nip N where a toner image on the intermediate transfer belt 31 is secondarily transferred onto the secondary transfer belt 404. With this configuration, the space S is small at a portion (the secondary transfer nip N) where the secondary transfer bias is applied to the secondary-transfer first roller 33 to generate a high electric field. Thus, the electrical discharge can be prevented in the space S.

The present inventor's experiment has revealed the following: The likeliness of the occurrence of the prenip electrical discharge varies with the voltage applied to the secondary-transfer first roller 33; the resistances and materials of the intermediate transfer belt 31, the secondary-transfer first roller 33, the secondary-transfer second roller 36, and the secondary transfer belt 404; the type of the recording sheet P; and conveyance conditions. Further, the prenip electrical discharge easily occurs on the intermediate transfer belt 31 made of an elastic material. Therefore, increasing the amount of offset of the secondary-transfer second roller 36 toward the upstream side in the direction b of conveyance of the recording sheet prevents the electrical discharge in the secondary transfer nip N.

Figure 5A:
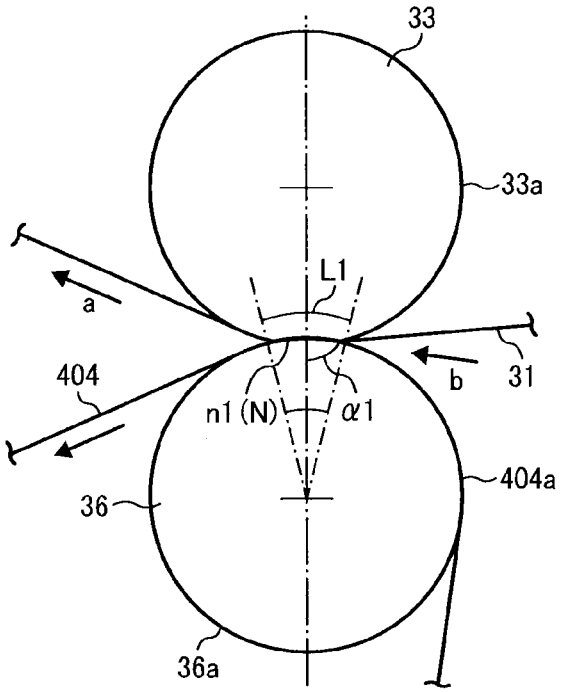
FIG. 5A is a view of a transfer nip.
Figure 5B:
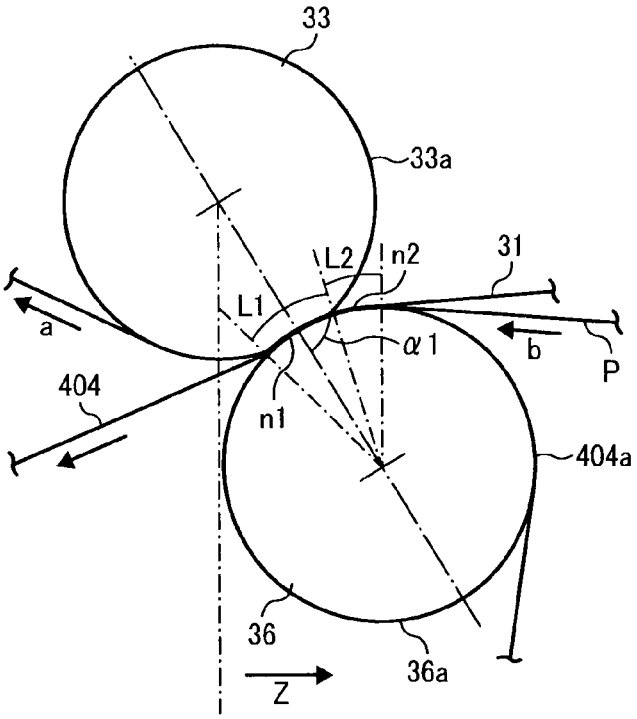
FIG. 5B is a view schematically illustrating a prenip.

Next, referring to FIGS. 5A and 5B, a description is provided of the secondary transfer nip according to the present embodiment.

In FIG. 5A, the intermediate transfer belt 31 and the secondary transfer belt 404 are pressed between the secondary-transfer second roller 36 and the secondary-transfer first roller 33 with a constant pressure. In this case, the secondary-transfer second roller 36 is not offset.

In FIG. 5B, the intermediate transfer belt 31 and the secondary transfer belt 404 are pressed between the secondary-transfer second roller 36 and the secondary-transfer first roller 33 with a constant pressure. In this case, the secondary-transfer second roller 36 is offset toward a direction indicated by arrow Z, that is, the upstream side in the direction of conveyance of the recording sheet.

Assuming that the distance between the center of the secondary-transfer first roller 33 and the center of the secondary-transfer second roller 36, and the manner in which the secondary transfer belt 40 is deformed by the rollers 33 and 36 are the same, the form of a nip is geometrically defined. As illustrated in FIGS. 5A and 5B, the lengths L1 of a nip n1 interposed between the secondary-transfer first roller 33 and the secondary-transfer second roller 36 are the same between FIG. 5A and FIG. 5B. The nip n1 is hereinafter referred to as a main nip n1. In the case of FIG. 5B with the secondary-transfer second roller 36 offset in the direction Z, a prenip n2 indicates a portion of the intermediate transfer belt 31 contacting only the outer circumferential surface 36*a* of the secondary-transfer second roller 36 via the secondary transfer belt 404. The length of the prenip n2 is the length L2.

The presence of the prenip n2 is determined by an angle $\alpha 1$ formed between a straight line connecting the shaft center of the secondary-transfer first roller 33 and the shaft center of the secondary-transfer second roller 36 and the direction of the intermediate transfer belt 31 stretched taut toward the upstream side of the main nip. The straight line is indicated by a broken line in the Figures. As illustrated in FIG. 5A, when the angle $\alpha 1$ is greater than or equal to 90 degrees, the prenip n2 is not formed. In contrast, as illustrated in FIG. 5B, when the angle $\alpha 1$ is less than 90 degree, the prenip n2 is formed.

In the present embodiment, the secondary transfer belt 404 is employed as a transfer device. In the case of the roller transfer method in which the secondary-transfer second roller 36 is used alone as the transfer device, the length L2 of a portion of the intermediate transfer belt 31, which is directly wound only around the outer circumferential surface 36*a* of the secondary-transfer second roller 36, corresponds to the prenip n2. When the secondary-transfer second roller 36 is not offset as in FIG. 5A, the width L of the secondary transfer nip N refers to the length L1 of the main nip n1. In contrast, when the secondary-transfer second roller 36 is offset as in FIG.5B, the width L of the secondary transfer nip N refers to the sum of the length L1 of the main nip n1 and the length L2 of the prenip n2.

In the configuration including the prenip n2, when the recording sheet P is in the main nip n1 interposed between the secondary-transfer first roller 33 and the secondary-transfer second roller 36, the back surface of the recording sheet P contacts the outer circumferential surface 36*a* of the secondary-transfer second roller 36 in the prenip n2. The front surface Pa of the recording sheet P contacts the outer circumferential surface 33*a* of the secondary-transfer first roller 33 via the intermediate transfer belt 31 in the main nip n1. Accordingly, the transfer current of the secondary transfer bias flows spreading in the plane direction of the recording sheet P (interface). In this case, the toner is more likely to be overcharged than the configuration without shifting the offset secondary-transfer second roller 36.

The electrical discharge in the upstream from the secondary transfer nip N in the direction b of conveyance of the recording sheet and the degree of margin in the electrical discharge differ with the type of intermediate transfer belt 31. For example, FIG. 6 indicates test results regarding the presence of the prenip electrical discharge in different type of secondary transfer belts with the amount of offset of the secondary-transfer second roller 36 changed.

It should be noted that the amount of prenip in FIG. 6 refers to the length of the front surface of the intermediate transfer belt 31 contacting only the secondary transfer belt 404 via the recording sheet P. When factors such as the hardness and the track of the intermediate transfer belt 31 to the nip, the diameters of rollers, and so forth other than the position of the secondary-transfer second roller 36 are fixed, the amounts of shift correspond to the amounts of prenip respectively. This is because the prenip is formed by shifting the secondary-transfer second roller 36.

Figure 7:
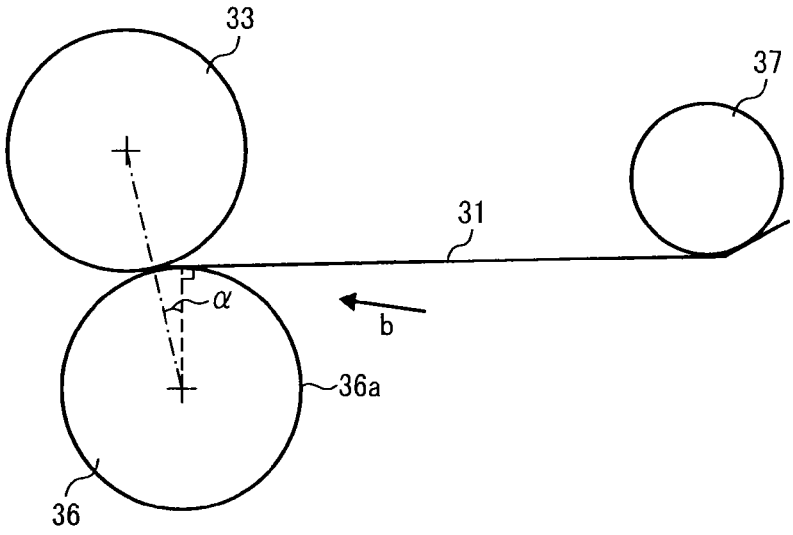
FIG. 7 is a view of an amount of prenip.

Now, there is provided of the amount of prenip according to the present embodiment referring to FIG. 7.

FIG.7 is a view of the secondary-transfer first roller 33, the secondary-transfer second roller 36, the intermediate transfer belt 31 made of an elastic material, and the pre-transfer roller 37. The angle α a is formed between the broken line connecting the center of the secondary-transfer first roller 33 and the center of the secondary-transfer second roller 36 and the vertical line from the center of the secondary-transfer second roller 36 to the intermediate transfer belt 31. The amount of prenip is defined by 2π×(the radius of the secondary-transfer second roller 36)×α/360 degree. The term "prenip" refers to a portion, which is wound around the outer circumferential surface 36*a* of the secondary-transfer second roller 36, of the intermediate transfer belt 31. Accordingly, the amount of prenip varies with the diameter of the secondary-transfer second roller 36 and the trajectory of the intermediate transfer belt 31. With the variable factors fixed, the amount of prenip is determined by the amount of offset of the secondary-transfer second roller 36. In FIG. 6 indicating the relations between the amount of prenip and the electrical discharge, the amount of prenip varies with the changes in the amount of offset.

In FIG. 6, the degree of margin in the electrical discharge is determined by various factors: belt type, the amount of prenip, paper types, and the amount of the secondary transfer current. The belt has two types such as an elastic belt and a polyimide (PI) belt. The amount of prenip is changed by shifting the secondary-transfer second roller 36 toward the upstream side in the direction of conveyance. Plain paper and thin paper are used. The amount of the secondary transfer current is changed as the secondary transfer bias. In FIG. 6, the term "GOOD" indicates that no image failure due to the electrical discharge was found. The term "FAIR" indicates that the electrical discharge slightly occurred. The term "POOR" indicates that image failure was easily found.

According to FIG. 6, higher the secondary transfer current, higher the secondary transfer voltage. That is, as the secondary transfer current is high, the electrical discharge easily occurs. If no electrical discharge occurs in a wider range of current, that is, even when high secondary transfer current is applied, the degree of margin in the electrical discharge is high. In the present embodiment, to provide favorable transferability, the target current Al is set 31 120 μA, at which it is necessary to generate no electrical discharge. In view of the transferability, it is necessary that the amount of prenip in the elastic belt is greater than or equal to 4 mm, and greater than or equal to 2 mm in the PI belt.

It should be noted that the test result (numerical values) indicated in FIG. 6 vary with the factors such as the film thickness, hardness, and process linear velocity of belt, and the diameter of the secondary-transfer second roller 36. That is, a necessary amount of prenip varies with an image forming apparatus. When compared in the same configuration, the degree of margin in electrical discharge is higher than the PI belt does. The amount of the main nip n1, which is illustrated in FIGS. 5A and 5B, is typically set from 2 mm to 5 mm.

In the configuration of FIG. 7, the secondary-transfer first roller 33 and the secondary-transfer second roller 36 have the same diameters. The secondary-transfer second roller 36 has a hardness of 70 HS in accordance with Japanese Industrial Standards (JIS-A), and the secondary-transfer first roller 33 has 50° on Asker C hardness scale. When the secondary-transfer second roller 36 is harder, the intermediate transfer belt 31 favorably exhibits the property of rubber. However, the combination of hardness of and the magnitude relation between the secondary-transfer first roller 33 and the secondary-transfer second roller 36 are not limited to those described above, and various numerical values and relations are available.

Further, irrespective of the relation between the diameter of the secondary-transfer first roller 33 and that of the secondary-transfer second roller 36 and the magnitude relation of the rollers 33 and 36, the image forming apparatus according to the present embodiment exhibits advantageous effects.

In the present embodiment, as illustrated in FIG. 7, the secondary-transfer second roller 36 is offset toward the upstream side in the direction b of conveyance of the recording sheet, causing the recording sheet P, which is advancing forward, to contact the intermediate transfer belt 31 at the upstream from the secondary transfer nip N. Accordingly, no space S as illustrated in FIG. 4B is formed between the intermediate transfer belt 31 and the recording sheet P before the secondary transfer nip N, thereby preventing the electrical discharge. Now, there is provided of the advantageous effects of the present embodiment from the viewpoint of the electric field. In the distribution of the transfer electric field, the strongest electric field is generated in the secondary transfer nip N, becoming weaker toward the upstream side in the direction of conveyance. When the recording sheet P comes to contact with the intermediate transfer belt 31 at the strong electric field, with a space S between the recording sheet P and the intermediate transfer belt 31 at the upstream of the strong electric field, the electrical discharge occurs in the space S. Therefore, contacting the recording sheet P with the intermediate transfer belt 31 at the upstream side of the weak electric field (the nip N) prevents the electrical discharge.

In the present embodiment, the secondary transfer bias is output from the power source 39 under constant current control to provide a constant transfer voltage (transfer electric field) irrespective of the resistances of the intermediate transfer belt 31 and the recording sheet P.

Next, a description is provided of different methods for measuring the amount of prenip with reference to FIGS. 8A through 8D and 9.

Figure 8A:
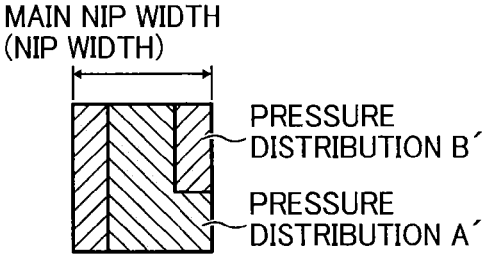
FIGS. 8A through 8D are illustrations of a process for measuring the amount of prenip.

In a method 1 for measuring the amount of prenip as illustrated in FIGS. 8A through 8D, the width of a main nip is first measured as illustrated in FIG. 8A. To measure the width of the main nip, a surface pressure sensor (i.e., I-SCAN (registered trademark), manufactured by Nitta Corporation) is used to specify a portion under pressure. More specifically, a pressure distribution A and a pressure distribution B indicated by differently hatched patterns are obtained, and the width of a portion under a pressure greater than a threshold is defined as the width of the main nip.

Figure 8B:
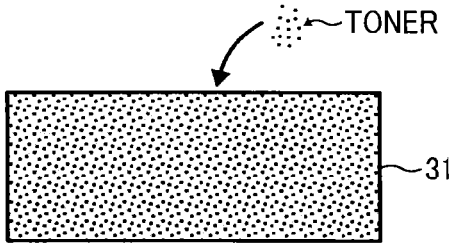
Figure 8C:
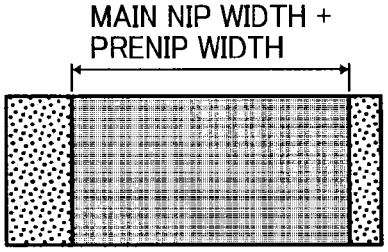

Next, the width of the main nip and a prenip is measure as illustrated in FIG. 8B. In this measurement, toner is caused to be adhered onto the intermediate transfer belt 31 in a certain degree of width, e.g., approximately 10 mm which is sufficiently wider than the width of the secondary transfer nip N.

Subsequently, a secondary transfer device is repeatedly moved to contact and separate from the intermediate transfer belt 31 with toner adhered onto. In the present embodiment, the secondary transfer unit 41 is moved to contact and separate from the secondary-transfer first roller 33. During such an operation, the secondary transfer unit 41 is drawn out to be cleaned as needed. After cleaned, the secondary transfer unit 41 is repeatedly moved again. When the secondary-transfer second roller 36 is used as the transfer device instead of the secondary transfer belt 404, the secondary-transfer second roller 36 is moved to contact and separate from the secondary-transfer first roller 33. Through such an operation of contact and separation, a portion of toner adhered onto the intermediate transfer belt 31 is repeatedly pressed by the secondary transfer device, so that the thickness of the portion becomes thin. This thin portion corresponds to a contact portion (the main nip and the prenip) where the secondary transfer device contacts the intermediate transfer belt 31.

Figure 8D:
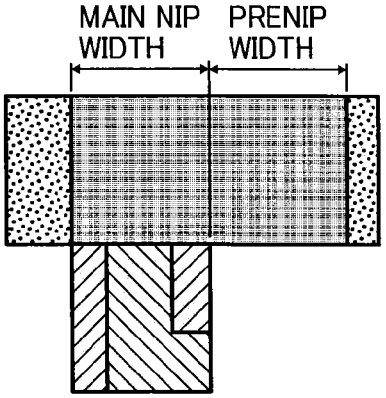

Referring to FIG. 8D, the width of the contact portion (the main nip and the prenip) is measured. Then, the width of the main nip is subtracted from this measured width to obtain the width of the prenip, which is the amount of the prenip.

Figure 9A:
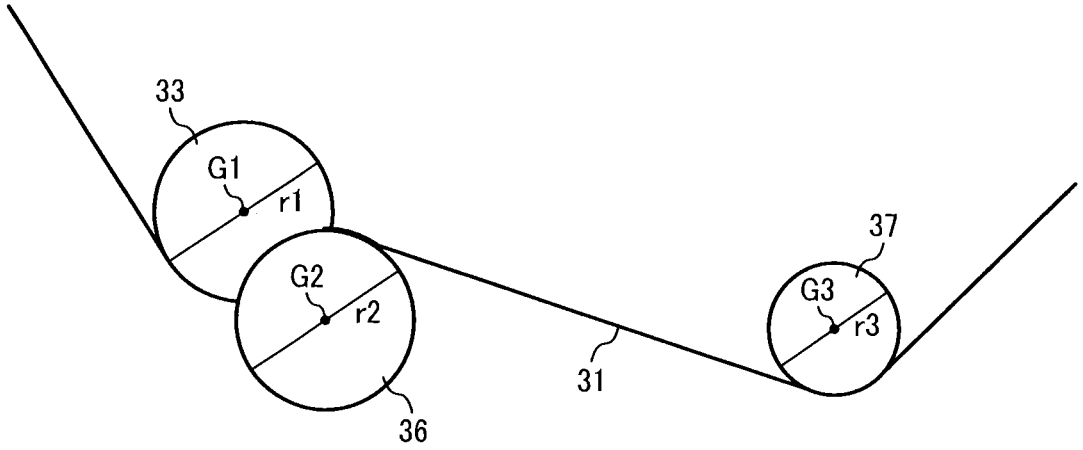
FIGS. 9A and 9B are illustrations of another process for measuring the amount of prenip.
Figure 9B:
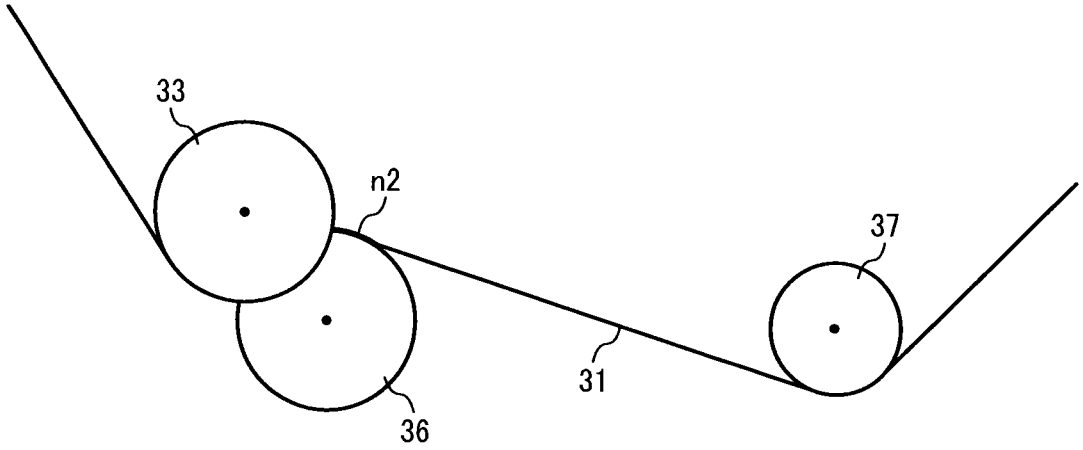

In a method 2 of FIGS. 9A and 9B, the coordinates of the shaft centers G1, G2, and G3 are first specified as illustrated in FIG. 9A. G1, G2, and G3 are the shaft centers of the secondary-transfer second roller 36, the secondary-transfer first roller 33, and the pre-transfer roller 37, respectively. Then, the outer diameters r1 and r2 and hardnesses of the secondary-transfer second roller 36 and the secondary-transfer first roller 33, and the outer diameter r3 of the pre-transfer roller 37 are measured.

Subsequently, the three rollers 33, 36, and 37 are outlined as illustrated in FIG. 9B. In this case, based on the measured hardnesses of the rollers 33 and 36, it is assumed that only either one having a lower hardness is deformed. Referring to the outline, a portion of the intermediate transfer belt 31 is wound around only the secondary-transfer second roller 36. This portion is defined as a prenip n2. Using the two methods as described above can specify the prenip n2.

It should be noted that the prenip refers to a portion in which the secondary-transfer first roller 33 and the secondary-transfer second roller 36 do not contact with each other, and an image bearer formed into a belt (the intermediate transfer belt 31) is wound around only the outer circumferential surface 36*a* of the secondary-transfer second roller 36 via the secondary transfer belt 404. The length of this portion is approximately 2 to 5 mm. This length of the portion is referred to as the amount of the prenip. The secondary-transfer first roller 33 and the secondary-transfer second roller 36 contact with each other to form a nip (which is referred to as a main nip). The length (amount) of the nip is approximately 2 to 5 MM.

Figure 10:
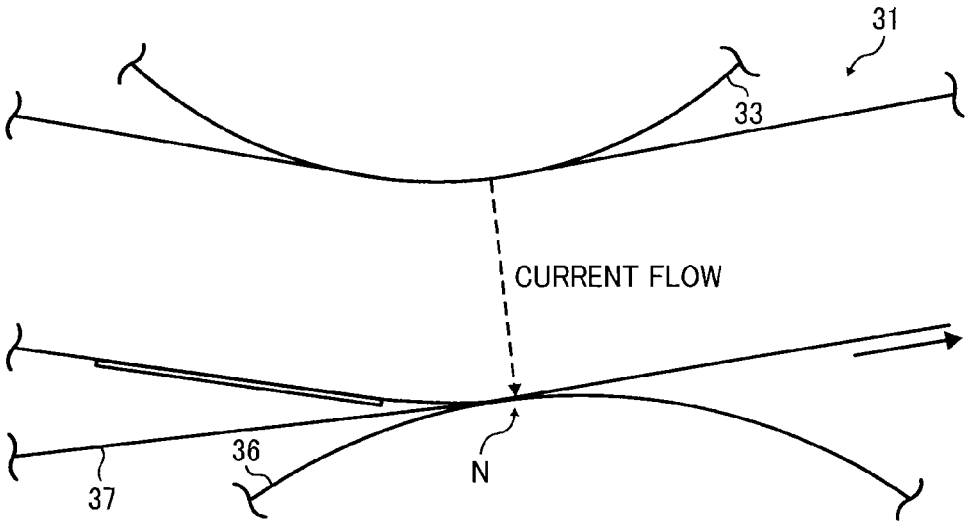
FIG. 10 is an enlarged view of a secondary transfer nip and a surrounding around a secondary transfer nip using a single-layer intermediate transfer belt which is different from the image forming apparatus of the present disclosure.

FIG. 10 is an enlarged diagram of a structure around the secondary transfer nip N using a single-layer intermediate transfer belt as the intermediate transfer belt 31. When the single-layer intermediate transfer belt is used as the intermediate transfer belt 31, a secondary transfer current flows between the secondary-transfer first roller 33 and the secondary-transfer second roller 36 in a manner described below. That is, the secondary transfer current is concentrated at the nip center (the center in the traveling direction of the belt) and flows linearly as indicated by arrow in FIG. 10. In other words, the secondary transfer current does not flow much near the nip start portion of the secondary transfer nip and near the nip end portion of the secondary transfer nip. When the secondary transfer current flows in such a manner described above, the time period during which the secondary transfer current acts on the toner is relatively short at the secondary transfer nip. Accordingly, excessive injection of electrical charges having a polarity opposite that of the normal polarity due to the secondary transfer current is suppressed, if not prevented entirely.

Figure 11:
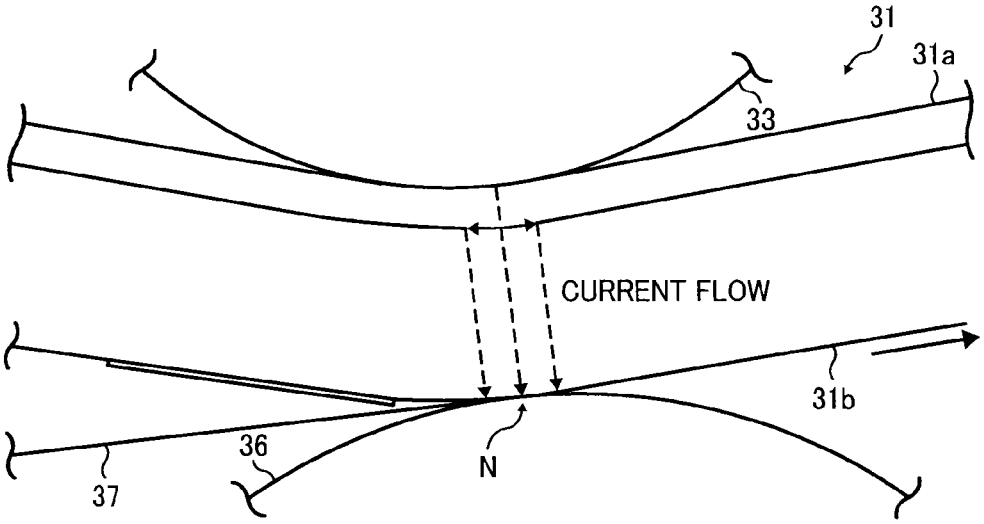
FIG. 11 is a partially enlarged cross-sectional view of a secondary transfer nip and a surrounding structure in the image forming apparatus according to an embodiment.

FIG. 11 is a partially enlarged cross-sectional view of the secondary transfer nip N and a surrounding structure according to an embodiment of the present disclosure. According to the present embodiment, as described above, a multi-layer intermediate transfer belt is used as the intermediate transfer belt 31. When the multi-layer intermediate transfer belt is used as the intermediate transfer belt 31, a secondary transfer current flows between the secondary-transfer first roller 33 and the secondary-transfer second roller 36 in a manner described below. When the multilayer intermediate transfer belt is used as the intermediate transfer belt 31, the secondary transfer current flows through an interface between the base layer 310 and the elastic layer 311 in the belt thickness direction while the secondary transfer current spreads in the circumferential direction of the intermediate transfer belt 31. As a result, the secondary transfer current flows not only in the center of the secondary transfer nip, but also at the nip start portion and at the nip end portion. This means that the secondary transfer current acts on the toner in the secondary transfer nip for an extended period of time. Thus, electrical charges having a polarity opposite to the normal polarity are easily and excessively injected to the toner due to the secondary transfer current, which results in a significant decrease in the amount of charge of the toner having the normal polarity and also results in a reverse charging of the toner. In both cases, the secondary transfer ability is impaired. As a result, image density easily becomes insufficient. The belt having multiple layers including three more layers also causes the similar spread of the secondary transfer current to the two-layer belt used in the image forming apparatus 100, which also hampers the secondary transferability. Thus, it has been found that such spread of the secondary transfer current deteriorates the secondary transferability.

Figure 12:
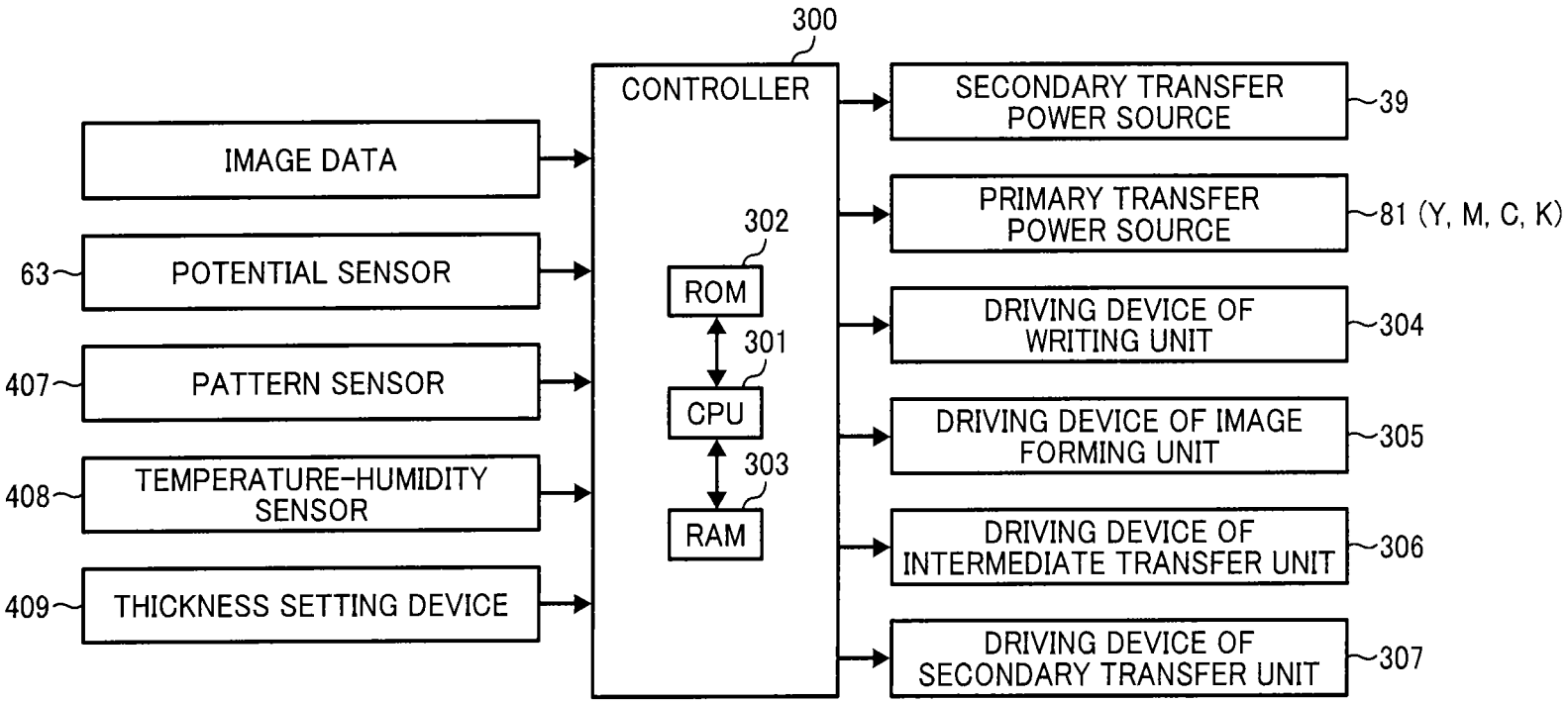
FIG. 12 is a block diagram of a control system according to one embodiment.
Figure 13:
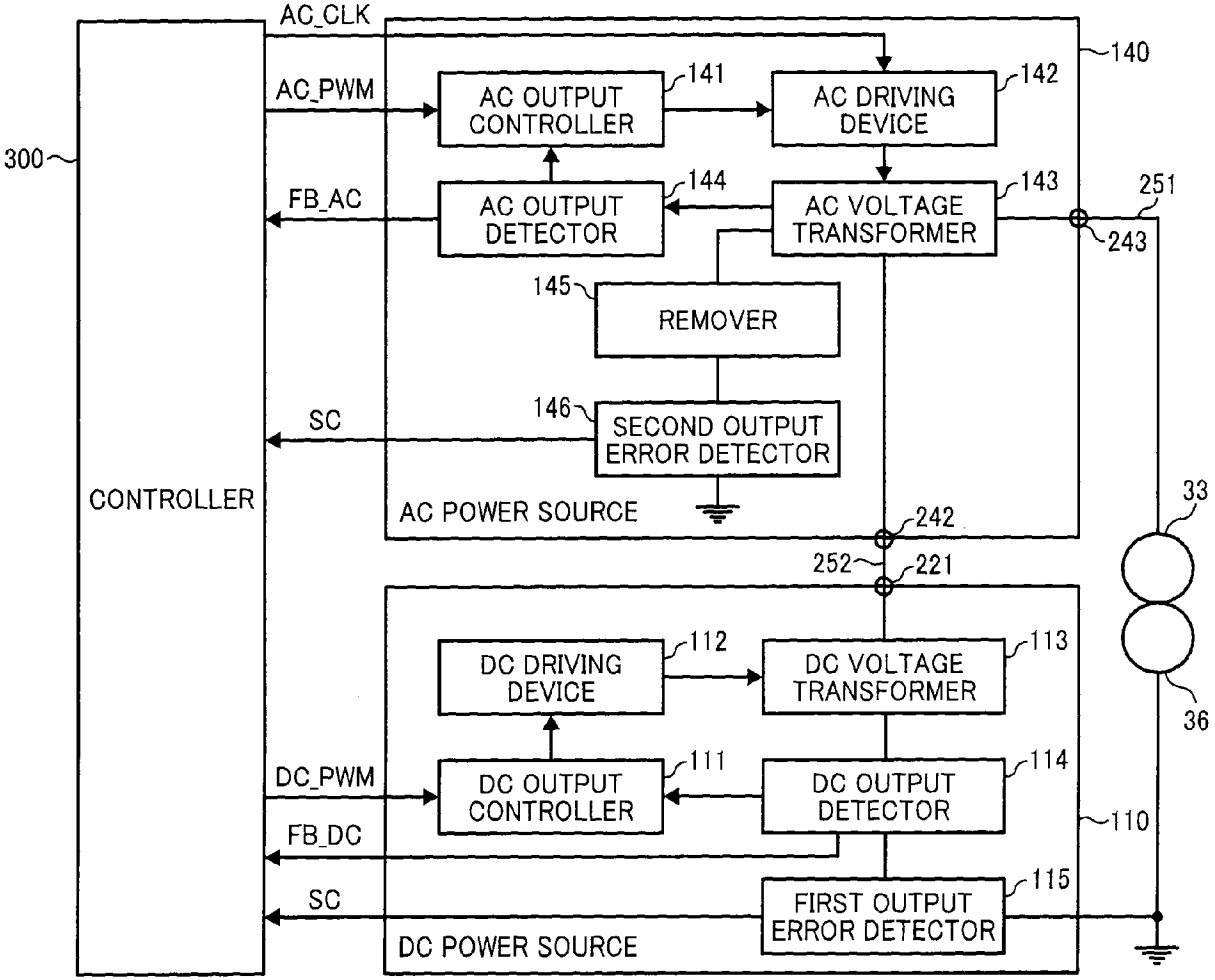
FIG. 13 is a block diagram of a part of an electric circuit of a transfer power source and constitutional elements according to an embodiment of the present disclosure.

Next, a description is provided of the image forming apparatus 100, referring to FIGS. 12 and 13.

As illustrated in FIG. 12, a controller 300 includes a central processing unit (CPU) 301 as a computing device, a read only memory (ROM) 302 as a nonvolatile memory, and a random access memory (RAM) 303 as a temporary storage device. The controller 300 typically includes various constitutional components and sensors communicably connected thereto via signal lines to control the entirety of the image forming apparatus 100. FIG. 13 illustrates representative components and sensors of the image forming apparatus 100. It should be noted that FIG. 12 illustrates the components and sensors employed in the present embodiments, and a description is provided of the components and sensors as devices that serve as the controller 300.

The controller 300 includes a potential sensor 63, a pattern sensor 407, a temperature-and-humidity sensor 408 as an environment-condition sensor, and a thickness setting device 409, which are connected to each other via signal lines, on an input side. The pattern sensor 407 detects the density of a test pattern transferred on the secondary transfer belt 404, and outputs data regarding the detected density. The temperature-and-humidity sensor 408 detects temperature and humidity at an installation location of the image forming apparatus 100 or in the interior of the apparatus body 100A, to output a temperature-and-humidity data t. The thickness setting device 409 determines and sets a thickness Pt of a recording sheet P to be printed.

The controller 300 further includes a power source 39 for secondary transfer, primary transfer power sources 81Y, 81M, 81C, and 81K for the colors of yellow, magenta, cyan, and black, a driving device 304 of a writing unit, a driving device 305 of an image forming unit, a driving device 306 of an intermediate transfer unit, and a driving device 307 of a secondary transfer unit, which are connected to each other via signal lines, on an output side.

The primary transfer power sources 81Y, 81M, 81C, and 81K apply a primary transfer bias to primary transfer rollers 35Y, 35M, 35C, and 35K.

The power source 39 applies a secondary transfer bias to the secondary-transfer first roller 33. The controller 300 controls the output from the power source 39. Alternatively, in some embodiments, another controller 300 controls the output of the power source 39, independently of the controller 300 that controls the entirety of the image forming apparatus 100.

The controller 300 of the image forming apparatus 100 includes an image adjustment mode to adjust the image density. The controller 300 compares the value detected by the potential sensor 63 with a predetermined value to determine whether it is an image adjustment timing. When the detection value is less than the predetermined value, an affirmative determination is made to initiate the image adjustment mode.

In the present embodiment, the image forming apparatus 100 includes an image adjustment mode to adjust image formation conditions. In the image forming apparatus 100, to adjust the image formation conditions with the image adjustment mode, a developing bias and a charging bias are changed to form a test pattern with toner, known as a density adjustment pattern. Then, the formed test pattern is transferred onto the secondary transfer belt 404, and the density of the test pattern is detected by the pattern sensor 407. The detected result (value) is used to adjust the image formation conditions. These operations are performed by the controller 300. According to the present embodiment, the density of the test pattern is detected on the secondary transfer belt 404. Alternatively, in some embodiment, the density is detected on the intermediate transfer belt 31.

In response to the initiation of the image adjustment mode, the controller 300 drives the driving device 304 of the writing unit and the driving device 305 of the image forming unit so as to form test patterns on the respective photoconductors. Subsequently, the controller 300 drives the primary transfer power sources 81Y, 81M, 81C, and 81K and the driving device 306 (a drive motor) of the intermediate transfer unit to transfer the test patterns (toner images) onto the intermediate transfer belt 31. The controller 300 also drives the power source 39 for secondary transfer and the driving device 307 of the secondary transfer unit to transfer the test patterns from intermediate transfer belt 31 onto the secondary transfer belt 404.

FIG. 13 is a block diagram of a portion of an electrical circuit of the power source 39 for the secondary transfer, and the secondary-transfer first roller 33, and the secondary-transfer second roller 36 according to an embodiment of the present disclosure. The power source 39 includes a direct current power source (hereinafter, referred to as a DC power source) 110 and an alternating current power source (hereinafter, referred to as an AC power source) 140. The power source 39 is connected with a controller 300 to control the output from the power source 39. In some embodiments, the power source 39 includes another controller different from the controller 300.

The DC power source 110 outputs a DC voltage to apply an electrostatic force to toner on the front surface 31 a of the intermediate transfer belt 31 so that the toner moves from the belt to the recording sheet P in the secondary transfer nip N. The DC power source 110 includes a DC output controller 111, a DC driving device 112, a DC voltage transformer 113, a DC output detector 114, a first output error detector 115, an electrical connector 221, and so forth.

The AC power source 140 outputs an AC voltage to form an alternating current electric field in the secondary transfer nip N. The AC power source 140 includes an AC output controller 141, an AC driving device 142, an AC voltage transformer 143, an AC output detector 144, a remover 145, a second output error detector 146, electrical connectors 242 and 243, and so forth.

The controller 300 inputs a DC_PWM signal and an output value of the DC voltage transformer 113 detected by the DC output detector 114 to the DC output controller 111. The DC_PWM signal controls an output value of the DC voltage. Based on the duty ratio of the input DC_PWM signal and the output value of the DC voltage transformer 113, the DC output controller 111 controls the DC voltage transformer 113 via the DC driving device 112 to adjust the output value of the DC voltage transformer 113 to an output value instructed by the DC_PWM signal.

The DC driving device 112 drives the DC voltage transformer 113 in accordance with the instruction from the DC output controller 111. The DC driving device 112 drives the DC voltage transformer 113 to output a DC high voltage having a negative polarity. In a case in which the AC power source 140 is not connected, the electrical connector 221 and the secondary-transfer first roller 33 are electrically connected by a harness 251 so that the DC voltage transformer 113 outputs (applies) a DC voltage to the secondary-transfer first roller 33 via the harness 251. In a case in which the AC power source 140 is connected, the electrical connector 221 and the electrical connector 242 are electrically connected by a harness 252 so that the DC voltage transformer 113 outputs a DC voltage to the AC power source 140 via the harness 252.

The DC output detector 114 detects and outputs an output value of the DC high voltage from the DC voltage transformer 113 to the DC output controller 111. The DC output detector 114 outputs the detected output value as a FB_DC signal (feedback signal) to the controller 300 to control the duty of the DC_PWM signal in the controller 300 so as not to impair transferability due to environment and load. According to the present embodiment, the AC power source 140 is detachably mountable relative to the body of the power source 39. Thus, an impedance in the output path of the high voltage output is different between when the AC power source 140 is connected and when the AC power source 140 is not connected. Consequently, when the DC power source 110 outputs the DC voltage under constant voltage control, the impedance in the output path changes depending on the presence of the AC power source 140, thereby changing a division ratio. Furthermore, the high voltage to be applied to the secondary-transfer first roller 33 varies, causing the transferability to vary depending on the presence of the AC power source 140.

In view of the above, according to the present embodiment, the DC power source 110 outputs the DC voltage under constant current control, and the output voltage is changed depending on the presence of the AC power source 140. With this configuration, even when the impedance in the output path changes, the high voltage to be applied to the secondary-transfer first roller 33 is kept constant, thereby maintaining reliably the transferability irrespective of the presence of the AC power source 140. Furthermore, the AC power source 140 can be detached and attached without changing the DC_PWM signal value. According to the present embodiment, the DC power source 110 is under constant-current control. Alternatively, in some embodiments, the DC power source 110 can be under constant voltage control as long as the high voltage to be applied to the secondary-transfer first roller 33 is kept constant by changing the DC_PWM signal value upon detachment and attachment of the AC power source 140 or the like.

The first output error detector 115 is disposed on an output line of the DC power source 110. When an output error occurs due to a ground fault or other problems in an electrical system, the first output error detector 115 outputs an SC signal indicating the output error such as leakage. With this configuration, the controller 300 stops the DC power source 110 to output the high voltage.

The controller 300 inputs an AC_PWM signal and an output value of the AC voltage transformer 143 detected by the AC output detector 144 to the AC output controller 141. The AC_PWM signal controls an output value of the AC voltage. Based on the duty ratio of the input AC_PWM signal and the output value of the AC voltage transformer 143, the AC output controller 141 controls the AC voltage transformer 143 via the AC driving device 142 to adjust the output value of the AC voltage transformer 143 to an output value instructed by the AC_PWM signal. The AC_PWM signal controls an output value of the AC voltage. Based on the duty ratio of the input AC_PWM signal and the output value of the AC voltage transformer 143, the AC output controller 141 controls the AC voltage transformer 143 via the AC driving device 142 to adjust the output value of the AC voltage transformer 143 to an output value instructed by the AC_PWM signal.

An AC_CLK signal to control the output frequency of the AC voltage is input to the AC driving device 142. The AC driving device 142 drives the AC voltage transformer 143 in accordance with the instruction from the AC output controller 141 and the AC_CLK signal. As the AC driving device 142 drives the AC voltage transformer 143 in accordance with the AC_CLK signal, the output waveform generated by the AC voltage transformer 143 is adjusted to a desired frequency instructed by the AC_CLK signal.

The AC driving device 142 drives the AC voltage transformer 143 to generate an AC voltage, and the AC voltage transformer 143 then generates a superimposed voltage in which the generated AC voltage and the DC high voltage output from the DC voltage transformer 113 are superimposed. When the AC power source 140 is connected, that is, the electrical connector 243 and the secondary-transfer first roller 33 are electrically connected by the harness 251, the AC voltage transformer 143 outputs (applies) the thus-obtained superimposed voltage to the secondary-transfer first roller 33 via the harness 251. When the AC voltage transformer 143 does not generate the AC voltage, the AC voltage transformer 143 outputs (applies) the DC high voltage output from the DC voltage transformer 113 to the secondary-transfer first roller 33 via the harness 251. Subsequently, the voltage (the superimposed voltage or the DC voltage) provided to the secondary-transfer first roller 33 returns to the DC power source 110 via the secondary-transfer second roller 36.

The AC output detector 144 detects and outputs an output value of the AC voltage from the AC voltage transformer 143 to the AC output controller 141. The AC output detector 144 outputs the detected output value as a FB_AC signal (feedback signal) to the controller 300 to control the duty of the AC_PWM signal in the controller 300 to prevent the transferability from dropping due to environment and load. The AC power source 140 carries out constant voltage control. Alternatively, in some embodiments, the AC power source 140 may carry out constant current control. The waveform of the AC voltage generated by the AC voltage transformer 143 (the AC voltage power source 140) is either a sine wave or a square wave. The AC voltage having a short-pulse square wave enhances image quality.

Various types of the recording sheet P having different thicknesses are used in the image forming apparatus 100. According to the present embodiment, the recording sheet P having a thickness Pt greater than a predetermined thickness Pt1 is defined as a thick paper. The recording sheet P having a thickness Pt less than the predetermined thickness Pt1 is defined as a thin paper. The recording sheet P having the predetermined thickness Pt1 is defined as plain paper. The thickness Pt of the recording sheet P is detected as the type of the recording sheet, such as thick paper, think paper, or plain paper in the image forming apparatus 100.

For example, in some embodiments, a paper type sensor is disposed above the cassette 60, to detect the type of the recording sheet P. The paper type sensor is connected with the controller 300 via a signal line, to compare data detected by the paper type sensor with a table of data regarding recording sheet stored in the ROM 302 to allow the controller 300 to determine the type (thickness) of the recording sheet P. Alternatively, in some embodiments, the thickness setting device 409 to set the type (thickness) of the recording sheet P is connected to the controller 300 via a signal line in the image forming apparatus 100 as illustrated in FIG. 12, allowing an operator, such as a user or a serving staff, to operate the thickness setting device 409 to arbitrarily select and input the type of the recording sheet P, sending the input data to the controller 300.

Next, a description is provided later of the secondary transfer bias according to the present embodiment.

Figure 14:
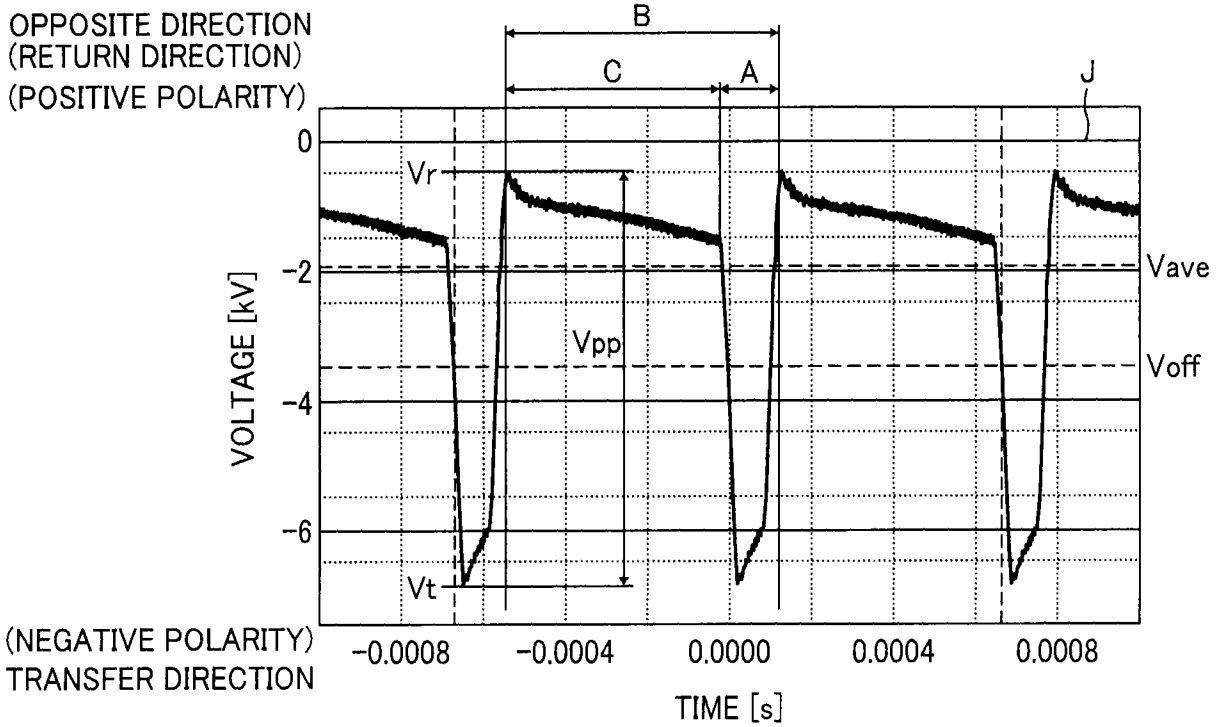
FIG. 14 is a waveform of a bias with a high duty output from the transfer bias power source according to an embodiment of the present disclosure.

FIG. 14 is a waveform chart showing a waveform of a secondary transfer bias output from the power source 39 according to an embodiment of the present disclosure. To transfer a toner image onto the recording sheet P, a constant amount of voltage is applied to the secondary transfer nip N. However, continuing to apply the voltage leads to overcharging of toner, which generates transfer failure, as described above.

In the waveform of FIG. 14, a requisite amount of voltage with a high duty greater than 50% is applied as the secondary transfer bias, so that a duration of the applied voltage is short and the overcharge of toner is prevented. The symbols in FIG. 14 are as follows: Vr is a peak value of a positive voltage (a peak value of a voltage having an opposite polarity/a peak value of a voltage in a return (opposite) direction (a return-directional voltage or an opposite-directional voltage)); Vt is a peak value of a negative voltage (a peak value of a voltage in a transfer direction (a transfer-directional voltage)); Voff (a peak-to-peak value) is (Vr+Vt)/2; Vpp is Vr−Vt; Vave is Vr×Duty/100+Vt×(1−Duty)/

100; A is a duration of Vt; B is a total time period of one cycle of voltage waveform; Duty is (B−A)/B×100%; and C is a duration of Vr. The term "duty" refers to a ratio of a duration of Vt (a time period of application of the transfer-directional voltage) to a duration of Vr (a time period of application of the return-directional voltage) in one cycle of an alternating voltage waveform. When a ratio of a value obtained by subtracting A from B with respect to B is greater (higher) than 50%, or C is greater than A by 50%, it is called a high duty.

Embodiment 1

When a duration of a peak voltage to transfer a toner image from an image bearer to a recording sheet is A, and a total time period of one cycle of application of the transfer bias is B in the superimposed bias as the transfer bias, a value of duty is obtained by the expression "(B−A)/B×100 (%)". The duty of greater than 50% is defined as a high duty. In this case, the averaged polarity of the transfer bias is toward a positive polarity (the centroid is toward the return direction), which is the same polarity as the charging polarity of toner. Accordingly, the transfer bias is insufficient to be applied to the recording sheet P positioned at the secondary transfer nip N.

Figures 15, 16:
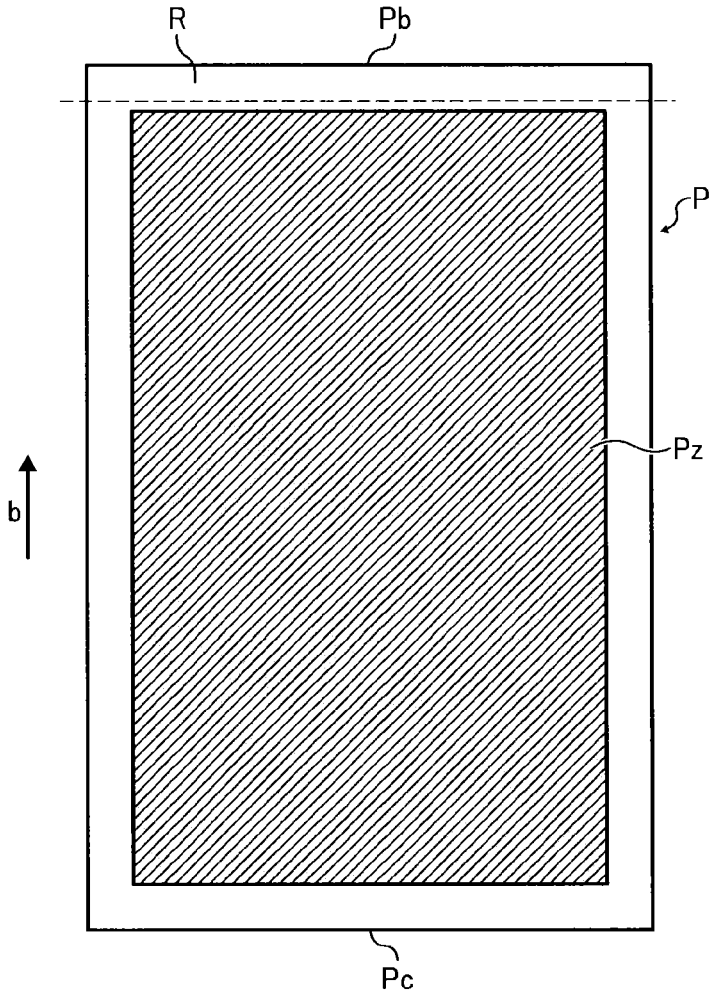
FIG. 15 is a plan view of a region subjected to a transfer bias correction and an image portion on a recording sheet.
FIG. 16 is a table of the results of image evaluation in Test 1 in which a ratio of a direct current component to an alternating current component in the transfer bias is varied.

As illustrated in FIG. 15, the recording sheet includes the leading end Pb and the trailing end Pc of the recording sheet P in a direction b of conveyance of recording sheet, and an image portion Pz where a toner image is transferred. No toner image is transferred onto the leading end portion and the trailing end portion. For this reason, the electrical resistance is high at the leading end portion of the recording sheet P passing the secondary transfer nip N, particularly before the toner is transferred onto the recording sheet P. Accordingly, the electrical resistance significantly changes while the recording sheet passes the secondary transfer nip N. This leads to an insufficient amount of the transfer bias to transfer the toner image onto the leading end side of the image portion on the recording sheet P.

Further, the toner image to be transferred onto the recording sheet P is a monochrome toner image or a multi-color toner image in which the toner images of different colors are laminated one atop the other. The multi-color toner image has a thick layer of toner, thereby having a high electrical resistance. Accordingly, transferring of such multi-color toner image is more likely to result in the deficiency of the transfer bias, thus reducing the image density on the leading end side of the image portion.

The recording sheet P has a different thickness Pt depending on the type of paper. The recording sheet P has a different electrical resistance depending on the thickness Pt. That is, the amount of the transfer bias to be applied differs depending on the thickness Pt of the recording sheet P.

In view of the above, in the present embodiment, when the superimposed bias of a high duty is applied as a secondary transfer bias, a ratio of a value of a direct current (DC) component to a value of an alternating current (AC) component of the superimposed bias within a region R is different from a ratio of a value of the DC component to a value of the AC component in the superimposed bias within the image portion Pz. The region R ranges from the leading end Pb of the recording sheet P to a predetermined length. The image portion Pz is outside the region R.

More particularly, the controller 300 controls the power source 39 to output the secondary transfer bias in the following manner: a ratio of a value of the DC voltage (DC electricity) as the DC component of the superimposed bias supplied within the region R to a value of the DC voltage (DC electricity) as the DC component of the superimposed bias supplied within the image portion Pz, i.e., outside the region R is greater than a ratio of a value of the AC voltage (AC electricity) as the AC component of the superimposed bias supplied within the region R to a value of the AC voltage (AC electricity) as the AC component of the superimposed bias supplied in the image portion Pz. Thus, the power source 39 is configured to switch between the secondary transfer bias output within the region R and the secondary transfer bias output in the image portion Pz. The power source 39 is controlled to change the ratio of a value of the AC voltage (AC component) to the value of the DC voltage (DC component) in the secondary transfer bias between the region R and the image portion Pz.

The region R is obtained as a time value preliminarily calculated by conveyance speed of the recording sheet P. The region R is stored in the ROM 302 as a table, in which a plurality of the regions R are associated with conveyance speeds. The controller 300 reads out the time value corresponding to the region R (region ranging to a predetermined length) from the ROM 302, according to the conveyance speed of the recording sheet P set. The controller 300 then controls the timing of outputting the secondary transfer bias from the power source 39 and the timing of switching the secondary transfer bias.

FIG. 16 is a table of the results of image evaluation in which a ratio of the AC component to the DC component in the superimposed bias as the secondary transfer bias is varied. The waveform of the secondary transfer bias used for the image evaluation of FIG. 16 is illustrated in FIG. 14. The secondary transfer bias includes the DC component of the same value as the time-averaged value (Vave) of the voltage, that is, a time-averaged voltage value (time-averaged value Vave) of the DC component. The time-averaged value of the voltage (Vave) refers to a value obtained by dividing an integral value of a voltage waveform over one cycle by the length of the one cycle. In the first embodiment, the power source 39 outputs a secondary transfer bias of a waveform of the following values to a secondary transfer nip N.

Vt: −7.0 kV; Vr: −0.6 kV; Voff: −3.8 kV; Vave: −2.0 kV; Vpp: 6.4 kV; Duration A of peak Vt: 0.10 ms; One cycle B of a waveform: 0.66 ms; and Duty: 85% (high duty).

In the present embodiment, the value of the AC component and the value of the DC component in the secondary transfer bias (superimposed bias) at the leading end portion are calculated by the following formulae, respectively. It should be noted that, the AC component and the DC component refer to the AC voltage and the DC voltage, respectively. Further, the values of the AC component and the DC component at the leading end portion refer to the values of the AC voltage and the DC voltage supplied within the region R.

AC Component of Transfer Bias [kV] at Leading End Portion=Vpp of Image Portion Pz [kV]×Correction Coefficient of AC Component in Leading End Portion [%]/100. DC Component of Transfer Bias [μA] in Leading End Portion=Transfer Bias [μA] of Image Portion Pz [kV]× Correction Coefficient of DC Component in Leading End Portion [%]/100. The obtained values of the AC component and the DC component are applied in the region R.

In FIG. 16, "POOR" in "IMAGE DENSITY" refers to an insufficient image density, and "GOOD" refers to a sufficient image density. The recording sheet P used in Test 1 is a plain paper having a basis weight of 80 g. Test 1 was performed under the environment conditions of a temperature of 23° C. and a humidity of 50%. The length from the leading end Pb is constant at 20 mm. That is, the length from the leading end Pb toward the center of the recording sheet P is 20 mm in the region R.

According to the results of Test 1 (FIG. 16), when the values of the AC component and the DC component are the same as those of the image portion Pz respectively, the image density at the leading end side of the recording sheet P is insufficient. When the correction coefficient of the DC component remains 100% (no change) and that of the AC component is 120%, which is higher than that of the DC component, and when the correction coefficient of the DC component and the AC component are 120%, the image density is insufficient. This is because, relatively increasing the value of the AC component increases the positive electric field, which is an opposite polarity of toner, resulting in the insufficient amount of the transfer-directional bias, thereby reducing the image density.

In contrast, when the value of only the DC component is changed to 120% higher than 100% of the AC component, the reduction in the image density on the leading end side of the recording sheet P is prevented. This successfully occurs because increasing the value of only the DC component increases the transfer-directional (negative) electric field. As a result, even when the recording sheet P enters the secondary transfer nip N to increase the electrical resistance, a sufficient amount of transfer bias is supplied for the secondary transfer process, thus preventing the reduction in the image density on the leading end side of the recording sheet P with the high-duty secondary transfer bias applied.

Figures 17, 18, 19:
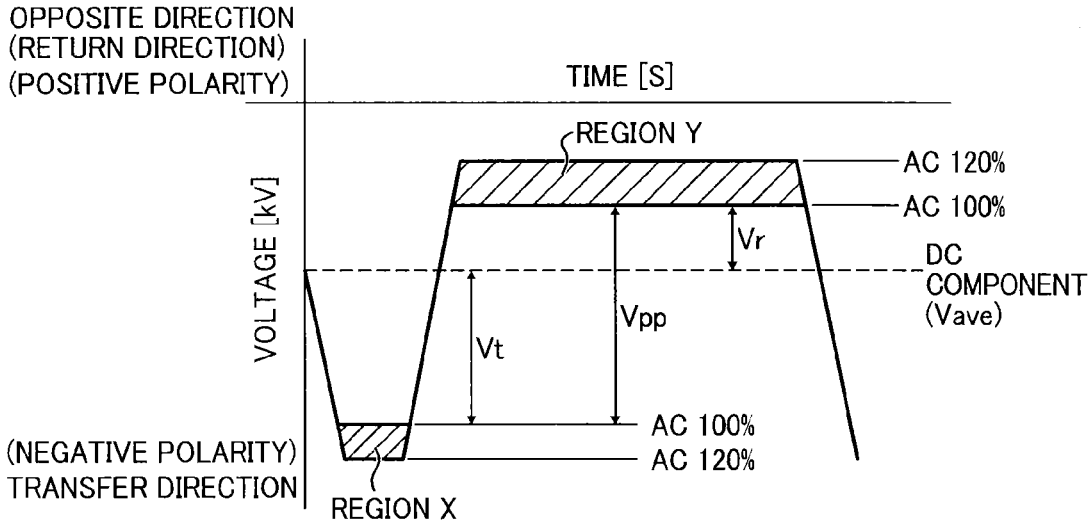
FIG. 17 is an illustration of operations and effects of the present disclosure.
FIG. 18 is a table of the results of image evaluation in Test 2 in which the length from the leading end of the recording sheet is varied.
FIG. 19 is a table of the results of image evaluation in Test 3 in which the value of the transfer bias applied to the leading end portion of the recording sheet is varied.

A detailed description is provided referring to FIG. 17. As illustrated in FIG. 17, increasing the value of AC component (Vpp) from 100% to 120% increases both the peak value Vr in the positive-polarity direction opposite to the toner-charged polarity and the peak value Vt in the negative-polarity direction same as the toner-charged polarity. In the present embodiment that uses the waveform of the AC component with a high duty, the increased amount ("REGION Y") of the positive electric field, which is an opposite polarity of toner, is greater than the increased amount ("REGION X") of the negative electric field in the transfer direction. That is, the positive electric field greatly contributes to transferring, compared to the negative electric field in the transfer direction, resulting in the reduction in the image density.

Thus, increasing the ratio of the transfer-directional electric field in the leading end portion to the transfer-directional electric field in the image portion Pz prevents a reduction in the image density due to the insufficient amount of transfer bias in the leading end portion, thus further preventing the reduction in the image density due to the excessive transferring of toner image onto the image portion Pz. In this case, when the ratio of the AC component in the superimposed bias increases, it is difficult to prevent a reduction in the image density because the increased amount of the positive electric field having an opposite polarity to that of toner is greater than the increased amount of the negative electric field in the transfer direction due to the high-duty superimposed bias applied. Accordingly, increasing the ratio of the DC component, which includes only the negative electric field in the transfer direction, in the superimposed bias prevents the reduction in the image density on the leading end Pb side of the recording sheet P even with a high-duty transfer bias applied.

It should be noted that, another configuration is applicable, that increases the value of the DC component at the leading end portion of the recording sheet P and changes the value of the AC component within the range that does not adversely effect the image density. For example, the value of the DC component in the leading end portion of the recording sheet P is 120%, and the value of the AC component in the leading end portion of the recording sheet P is 95%, or 105%.

(Test 2)

FIG. 18 is a table of the results of sensory evaluation, in which the predetermined length of the region R ranging from the leading end Pb of the recording sheet P to a predetermined length is varied. In FIG. 18, "POOR" refers to an insufficient image density, "FIAR" refers to slightly insufficient image density, and "GOOD" refers to a sufficient image density.

The recording sheet P used in Test 2 is a plain paper having a basis weight of 80 g. Test 2 was performed under the environment conditions of a temperature of 23° C. and a humidity of 50%. In the present embodiment, the value of the AC component is 100%, and the value of the DC component in the secondary transfer bias (superimposed bias) is 120%. That is, in the recording sheet P, the length from the leading end Pb, which corresponds to the length of the region R from the leading end Pb, is varied from 5 mm through 30 mm.

According to the results of Test 2, when the length of the region R from the leading end Pb is less than 10 mm, the image density is insufficient. This is because, the length of the region R from the leading end Pb is not long enough, and the amount of the secondary transfer bias is not adequate relative to change in the electrical resistance while the recording sheet P passes the transfer nip. In contrast, the length of the region R from the leading end Pb is 20 mm and 30 mm respectively, insufficient image density was not observed on the leading end Pb side of the image portion, and successful results were obtained. Such successful results are obtained because the secondary transfer bias, in which the value of the DC component is greater than the value of the AC component, is applied to the region R ranging from the leading end Pb to a length of at least 20 mm or greater, thereby preventing the reduction in the image density on the leading end side of the image portion. That is, a bias correction process is performed in the leading end portion.

(Test 3)

FIG. 19 is a table of the results of sensory evaluation, in which the length of the region R from the leading end Pb of the recording sheet P is constant, and in the secondary transfer bias (superimposed bias) for the bias correction process, the correction coefficient of the AC component is 100%, and only correction coefficient of the DC component is variable. Further, three types of toner images, such as a monochrome toner image, a two-color toner image, a three-color toner image, are evaluated. With each increase in color, a toner image of an additional color is laminated onto a previously formed toner image, thus increasing the thickness of the resultant toner image. In FIG. 18, "POOR" refers to an insufficient image density, "FIAR" refers to slightly insufficient image density, and "GOOD" refers to a sufficient image density.

The recording sheet P used in Test 3 is a plain paper having a basis weight of 80 g. Test 3 was performed under the environment conditions of a temperature of 23° C. and a humidity of 50%. In the present embodiment, the value of the AC component is constant at 100% in the secondary transfer bias (superimposed bias). That is, in the recording sheet P, the length from the leading end Pb, which is the length of the region R, is varied from 5 mm through 30 mm.

According to the results of Test 3, when a monochrome toner image is formed, the DC component of 100% (correction coefficient), which is the same as the AC component, allows a successful transferring of the toner image. However, when a toner image of two or more colors is formed, the thickness of the toner image increases, thereby increasing the electrical resistance, resulting in an increase in the amount of the secondary transfer bias to be applied. Increasing the correction coefficient of the DC component greater than 120% prevents the reduction in the image density of a three-color toner image. However, increasing the correction coefficient of the DC component greater than 130% results in the insufficient image density of the single-color toner image. Such insufficient image density generates because the excessive amount of the secondary transfer bias is applied to the single-toner image.

As a result, in the bias correction process with the secondary transfer bias, in which the correction coefficient of the DC component is greater than that of the AC component, the optimal correction coefficient of the DC component is 120% relative to 100% of the AC component. That is, the value of the DC component is preferably 1.2 greater than the value of the AC component.

FIG. 20 is a table of optimal values of the basis weight (thickness) of the recording sheet P, the temperature and humidity as the environment conditions, the length of the region R from the leading end Pb, and the secondary transfer bias. In FIG. 20, with the basis weight of the recording sheet P, which is correlated with the thickness of the recording sheet P, greater, the thickness Pd of the recording sheet P increases, thereby increasing the electrical resistance, which increases the secondary transfer bias to be output accordingly. The correction value (correction coefficient %) of the DC component of the secondary transfer bias gradually increases.

The length from the leading end Pb corresponding to the region R to be subjected to the bias correction process gradually increases as the thickness Pd (basis weight) of the recording sheet P increases.

Further, with the temperature and humidity decreasing, the electrical resistance of the intermediate transfer belt 31, the secondary transfer belt 404, the secondary-transfer first roller 33, the secondary-transfer second roller 36, and the recording sheet P increases. The secondary-transfer first roller 33 contacts the secondary-transfer second roller 36 via the intermediate transfer belt 31 and the secondary transfer belt 404, which contact the recording sheet P, to form the secondary transfer nip N. In the secondary transfer bias for the bias correction process in the leading end portion, the correction value (correction coefficient (%)) of the DC component relative to that of the AC component gradually increases as the temperature and humidity decreases Thus, changing the correction value (correction coefficient (%)) of the DC component in the secondary transfer bias according to data prevents a reduction in the image density of the toner image on the leading end side of the recording sheet P. The data includes the thickness Pt of the recording sheet P and the temperature-and-humidity data t as the environment conditions of the image forming apparatus 100, those influence the electrical resistance of the recording sheet P. As a result, a favorable image is obtained.

In the image forming apparatus 100 according to the present embodiment, data illustrated in FIG. 20 is stored in the ROM 302 as a table. The temperature-and-humidity sensor 408 of FIG. 12 detects temperature-and humidity data t. The thickness setting device 409 determines and sets thickness Pt of the recording sheet P to be printed.

The controller 300 captures temperature-and-humidity data t detected by the temperature-and-humidity sensor 408 and data regarding thickness Pt set by the thickness setting device 409. The controller 300 selects, from the table of FIG. 20, the values of the transfer current at the image portion, the DC component of the secondary transfer bias for the bias correction process, the length of the region R from the leading end Pb of the recording sheet, the correction coefficient (%). According to the selected values, the controller 300 controls the amount of the secondary transfer bias output from the power source 39. It should be noted that the "correction coefficient" described herein is a correction coefficient relative to a transfer current in the image portion as 100% for each thickness (basis weight) Pt of the recording sheet P. For example, when the basis weight is 80 gsm, the transfer current is 114 μA relative to a transfer current of 100% in the image portion. When the basis weight is 324 gsm, the transfer current is 124 μA to relative to a transfer current of 100% in the image portion.

Such configuration sets the suitable amount of the secondary transfer bias and the suitable size of the region R according to thickness Pt of the recording sheet P and the temperature and humidity as the environment conditions. This thereby prevents a reduction in the image density on the leading end side of the recording sheet P.

In the image forming apparatus 100 according to the present embodiment, the controller controls the power source 39 to output a high-duty transfer bias at the start of the bias correction process in the leading end portion while the region R of the recording sheet P passes the secondary transfer nip N.

In the image portion Pz, when the alternated secondary transfer bias has the positive-polarity peak value Vt, which is opposite to the charge polarity of toner, electrostatic migration of the toner from the intermediate transfer belt 31 to the recording sheet P is inhibited. When the secondary transfer bias has the negative-polarity peak value Vt, electrostatic migration of the toner from the intermediate transfer belt 31 to the recording sheet P is accelerated. With such a secondary transfer bias, the time period, during which electrical charges having the positive polarity opposite to the charge polarity of the toner may possibly be injected to the toner, in the one cycle B, is shortened. This prevents a reduction in the amount of charge of toner within the secondary transfer nip N due to the injection of the electrical charges to toner. Accordingly, insufficient image density caused by a decrease in the transferability due to a reduction in the toner charge amount can be suppressed, if not prevented entirely.

In the present embodiment, the region R does not overlap the image portion Pz as illustrated in FIG. 15. The present disclosure is not limited to this embodiment. That is, in the present embodiment, the (total) length of the region R from the leading end Pb is variable within a certain range. Further, the size of the image portion Pz changes according to set of margin. With such changes, a position of the leading end Pb of the image portion Pz changes as well.

Accordingly, the image portion Pz outside the range of a predetermined length may overlap the region R within the range of a predetermined length depending on the length of the region R and the margin set. In such a case as well, the bias correction process is performed in the present embodiment.

For example, even with small or no margin, increasing the value of the DC component relative to the value of the AC component in the bias to be applied to the leading end portion prevents a reduction in the image density of the leading end side of the image portion Pz.

In the embodiment described above, as the waveform of the secondary transfer bias output from the power source 39, the peak value Vr of the opposite-directional bias is set toward the transfer direction side (a negative polarity side) with respect to 0 V as illustrated in FIG. 14. The waveform rises and falls between the peak value Vr and the peak value Vt in the negative voltage side with respect to 0 V. However, the secondary transfer bias is not limited to such waveform.

Figure 21:
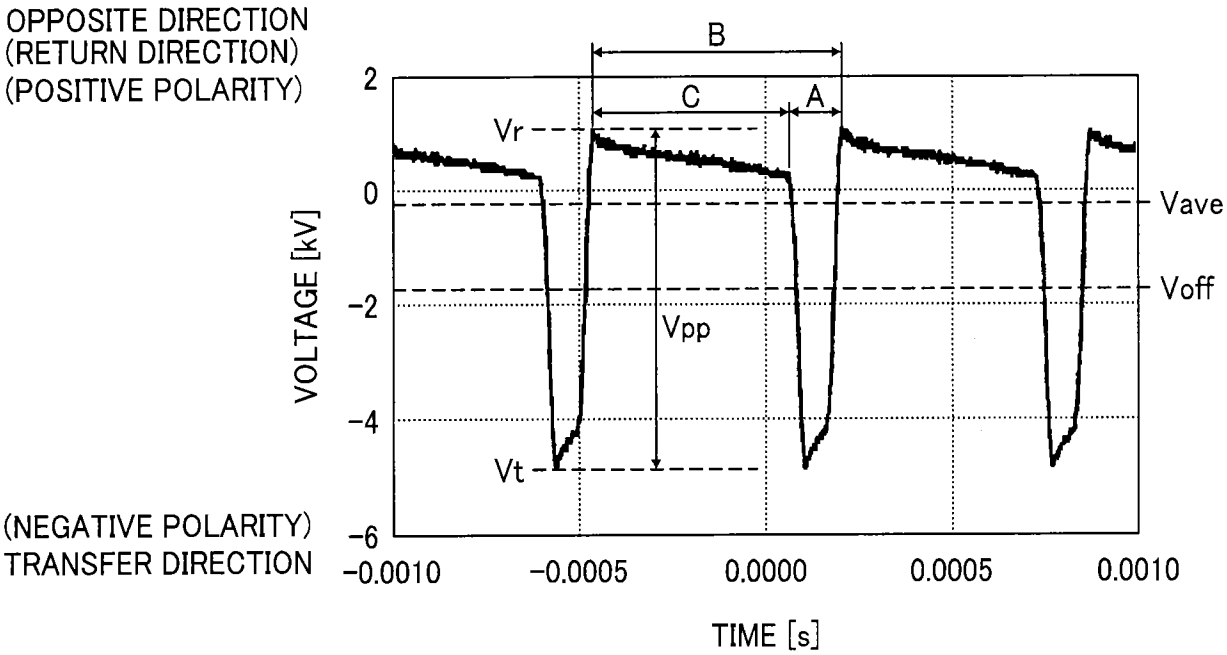
FIG. 21 is a waveform of a bias with a high duty output from the transfer bias power source according to another embodiment of the present disclosure.

For example, as illustrated in FIG. 21, a rectangular wave is applicable in another embodiment, in which the AC waveform rises and falls across 0 V between the peak value Vr of a positive voltage and the peak value Vt of a negative voltage. In this case as well, duty is greater than 50%.

Figure 22A:
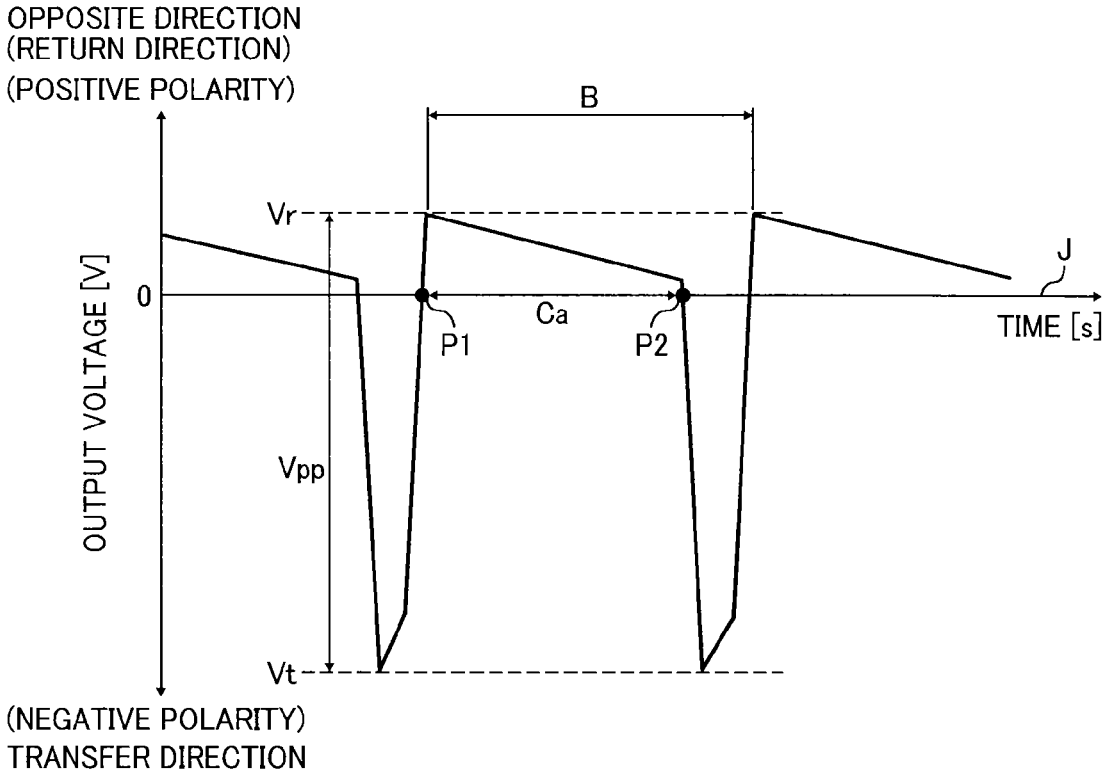
FIGS. 22A through 22C are schematic graphs of a waveform of FIG. 21 to describe duty.
Figure 22B:
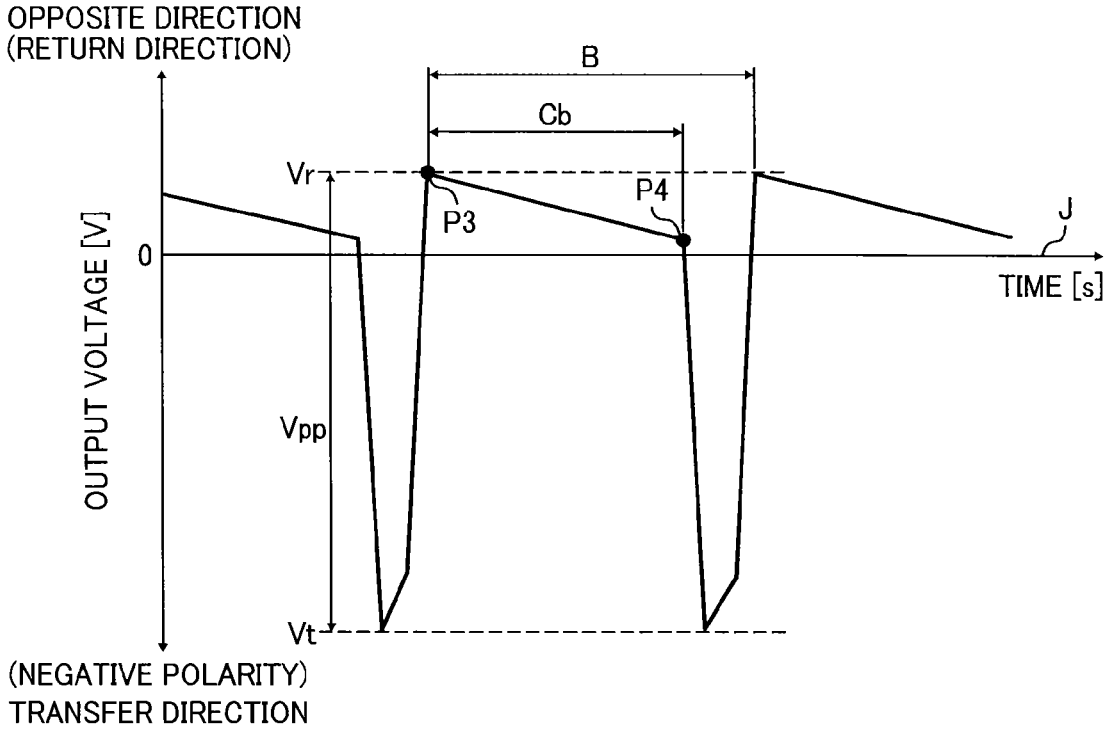
Figure 22C:
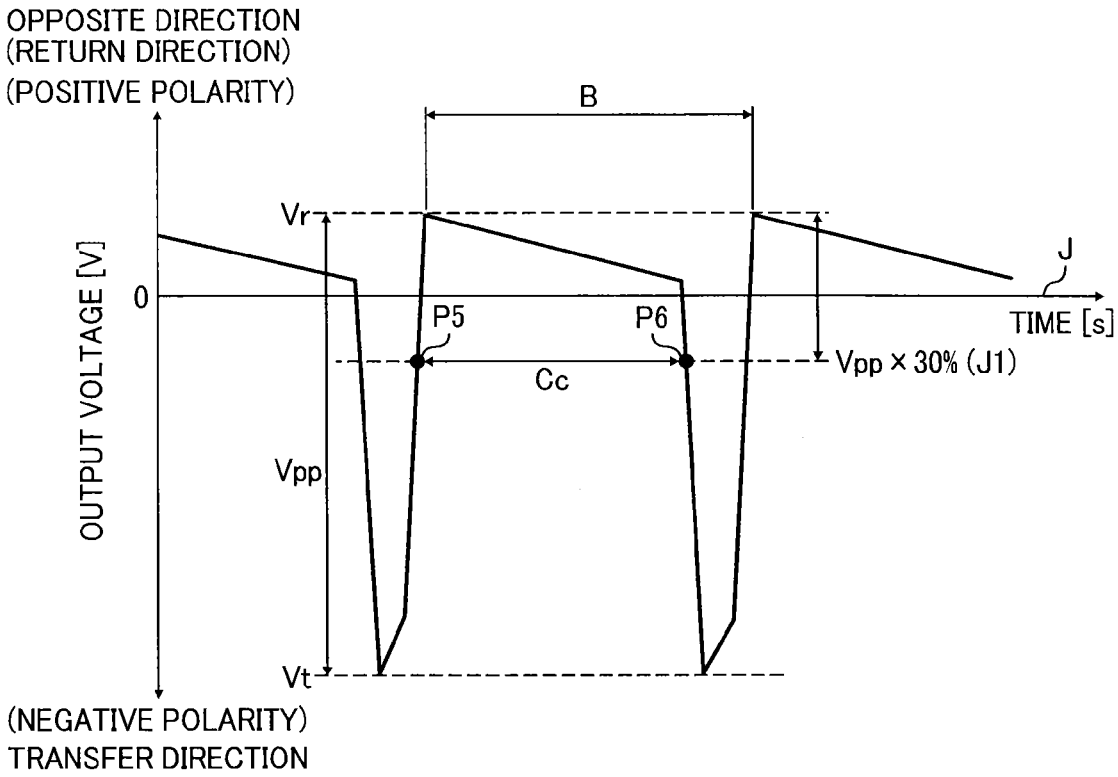

Alternatively, any of the waveforms of the secondary transfer bias as illustrated in FIGS. 22A through 22C is applicable. Each of FIGS. 22A through 22C is a schematic graph of the waveform of FIG. 21. A description is provided of duty referring to the drawings.

The alternating current (AC) bias, which is the AC component included in the secondary transfer bias, alternates between the transfer-directional bias and the opposite-directional bias in the opposite direction of the transfer direction. In the present embodiment, the "transfer-directional" bias has a negative polarity, and the "opposite-directional" bias has a positive polarity. The transfer directional bias and the opposite-directional bias have polarities different from each other with a polarity switching baseline J, at which the voltage is 0 V. The time period, during which the opposite-directional bias is applied within one cycle B, refers to a time period Ca from P1 to P2, during which the bias having a positive polarity opposite to in the transfer direction with 0 V is applied, as illustrated in FIG. 22A.

Referring to FIG. 22B, the time period of application of the opposite-directional bias in the one cycle B refers to a time period Cb ranging from P3 to P4. P3 is when the bias reaches the opposite-directional peak voltage Vr, and P4 is when the bias starts to rise to the transfer-directional peak voltage Vt. Referring to FIG. 22C, the time period of application of the opposite-directional bias in the one cycle B is a time period Cc from P5 to P6, which is on the opposite direction side with respect to a baseline J1. In this case, this baseline J1 refers to a line at a position shifted from the opposite-directional peak voltage Vr to the transfer-directional peak voltage Vt by 30% of Vpp.

Any type of waveform pattern of the secondary transfer bias is applicable, in which duty is greater than 50%, and Voff as the value of the DC component has a polarity (a negative polarity in the present embodiments) to move toner to a recording sheet P.

In the present embodiment, the intermediate transfer belt 31 is made of an elastic material to increase the transferability of a recording sheet P having an uneven surface. After the toner of the four colors are primarily transferred onto the intermediate transfer belt 31, the four-color composite toner image is transferred secondarily from the intermediate transfer belt 31 onto the recording sheet P. The intermediate transfer belt 31 includes a base layer 310, an elastic layer 311, and a coating layer 312, which are laminated in this recited order from the inner side. The base layer 310 is made of resins such as polyimide and polyamide-imide with a thickness of 50 μm to 100 μm. The elastic layer 311 is made of an acrylic rubber. The coating layer 312 has releasability. The elastic layer 311 typically has a thickness of 100 μm to 1 mm. To prevent transfer failure, a pressing force adequate for the secondary transfer is applied to the intermediate transfer belt 31 according to the elastic property of the intermediate transfer belt 31. This provides a favorable transferability of toner even in concave portions of the unevenness of the recording sheet P.

When the elastic layer 311 with such a configuration is used as the intermediate transfer belt 31, a high transfer voltage is applied to the elastic layer 311 for a successful secondary transfer. For examples, a plurality of pressing devices serving as a secondary transfer pressing device are employed to vary a transfer pressure with the type of the recording sheet P such as the degree of an unevenness, the thickness, and so forth.

However, applying an adequate amount of transfer pressure causes the recording sheet P to have a high adhesion property relative to the intermediate transfer belt 31, thereby interfering with the separation of the recording sheet P, which has passed through the secondary transfer nip N, from the intermediate transfer belt 31. That is, a separation failure occurs. Such a failure is pronounced in the roller scheme that employs a secondary-transfer second roller 36. Therefore, it is preferable for the image forming apparatus to combine with a secondary transfer unit 41 of the secondary transfer belt scheme according to the first embodiment to attain both the ability of separation of the recording sheet P from the intermediate transfer belt 31 and the transferability of the toner images onto the recording sheet P.

As it is apparent from the test that an elastic intermediate transfer belt 31 is weaker in the prenip electrical discharge than the PI belt.

Accordingly, a prenip in the elastic intermediate transfer belt 31 is formed to be wider than the PI belt does. Thus, in the present embodiment, the length of the prenip is 5.2 mm, which is longer than that in the first embodiment. In this case, the "length" refers to a length along the direction b of conveyance of the recording sheet.

As described above, as a large size of prenip is formed in the elastic intermediate transfer belt 31, the length of the secondary transfer nip N increases. This causes toner to be easily overcharged. Therefore, a high-duty (with a duty greater than 50%) superimposed bias is preferably applied as the secondary transfer bias when an elastic belt is used for a intermediate transfer belt 31. With this configuration, higher ability of separation of the recording sheet P and transferability onto the recording sheet P is secured, thus preventing abnormal images from being generated due to the overcharge of toner, as compared to using the PI belt for the intermediate transfer belt 31.

The intermediate transfer belt 31 made of an elastic material can be employed as the elastic belt having particles 313 as illustrated in FIGS. 3B and 3C. As such an elastic belt with an upper most layer (i.e., the elastic layer 311), in which particles 313 are dispersed, is used, a contact area of a belt surface with toner in the secondary transfer nip N is reduced. With this configuration, the ability of separation of the toner from the belt surface can be enhanced, thereby enhancing the transfer rate.

However, when the secondary transfer current flows concentrically between the insulating particles 313 which are arranged regularly, the electrical charges having an opposite polarity of toner get injected easily to the toner, resulting in the overcharge of the toner. As a result, even when the particles 313 are dispersed to enhance the transfer rate, the secondary transfer rate may decrease.

In view of this, the secondary transfer bias with a high duty (with a duty greater than 50%) is applied to reliably enhance the secondary transfer rate by the particles 313.

As the particles 313, particles capable of getting oppositely charged to the normal charging polarity of the toner are employed. In the image forming apparatus 100 according to the present embodiment, the particles 313 are constituted of melamine resin particles having a positive charging property. With this configuration, electrical charges of the particles 313 suppress concentration of the secondary transfer current between the particles, hence further reducing the injection of opposite electrical charges to the toner. Alternatively, in some embodiments, particles having charge property of the same charge polarity as the normal charge polarity of the toner are used as the particles 313. For example, silicone resin particles having a negative charge property (i.e., Tospearl (registered trademark)) may be used in the image forming apparatus according to the present embodiment.

Figure 23:
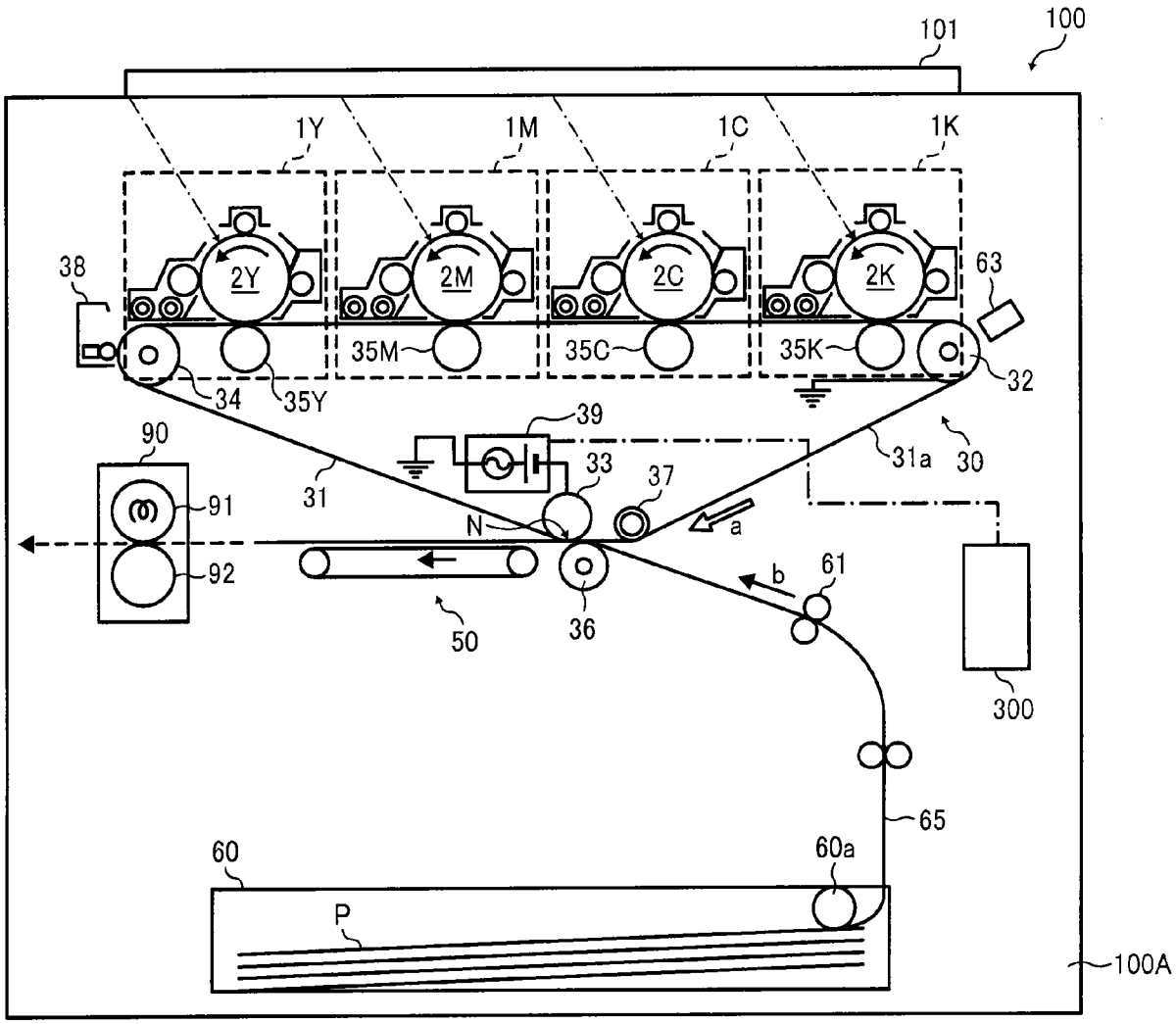
FIG. 23 is a schematic view of an image forming apparatus according to another embodiment of the present disclosure.

The image forming apparatus 100 of the present embodiments employs the secondary transfer belt unit 41 including the secondary-transfer second roller 36 and the secondary transfer belt 404 as the transfer device. Alternatively, instead of the belt method, the image forming apparatus 100 may employ a roller method in which the secondary-transfer second roller 36 directly contacts and separates from the intermediate transfer belt 31 as illustrated in FIG. 23. The secondary-transfer second roller 36 can be also referred to as a secondary-transfer opposed roller. The intermediate transfer belt 31 is interposed between the secondary-transfer first roller 33 and the secondary-transfer second roller 36, thereby forming a secondary transfer nip N. The secondary transfer nip N is referred to as a transfer portion. In this case as well, the secondary transfer bias is output from the power source 39 to the secondary-transfer first roller 33. Further, the secondary-transfer second roller 36 is connected to ground. With this configuration, a secondary transfer electrical field is formed in the secondary transfer nip N between the secondary-transfer first roller 33 and the secondary-transfer second roller 36 so that the toner having a negative polarity is electrostatically transferred from the secondary-transfer first roller 33 to the secondary-transfer second roller 36. A transfer bias may be applied to the secondary-transfer second roller 36. A conveyor 50 is disposed between the secondary-transfer second roller 36 and the fixing device 90 so that the recording sheet P is reliably conveyed to the fixing device 90 after the secondary transfer.

Using a belt for transfer has an advantageous effect in ease of separation of a thin paper. However, the electrical discharge is more likely to occur in such thin paper. Therefore, the secondary-transfer second roller 36 is advantageously shifted toward the upstream side in the direction of conveyance of the recording sheet to prevent the occurrence of the electrical discharge in thin paper as well.

That is, when transferring a toner image from the intermediate transfer belt 31 onto the recording sheet P, the power source 39 outputs the secondary transfer bias that cyclically alternates the transfer-directional voltage and the return-directional (opposite-directional) voltage in an opposite direction of the transfer direction. With the transfer-directional voltage output, the toner image is transferred from the intermediate transfer belt 31 to the recording sheet P. In the waveform of such a secondary transfer bias, the output voltage may alternate between the transfer-directional voltage and the return-directional voltage in the polarity on the return direction side of 0 V when the transfer-directional voltage is Vr and the return-directional voltage is Vt.

As described above, in the present embodiments, the amount of the secondary transfer nip N which is the transfer portion, is increased by forming a prenip at the upstream side in direction b of conveyance of the recording sheet. Due to the increased secondary transfer nip N, toner is overcharged, thereby generating the electrical discharge. Such an electrical discharge due to the increase of the secondary transfer nip N also occurs in the secondary transfer nip N, which has increased toward the downstream side in the direction b of conveyance of the recording sheet. Thus, when the transfer bias (the secondary transfer bias) with a duty of 50% or greater is applied, the configuration with the secondary transfer nip N expanded (increased) downstream in the direction of conveyance of recording sheet is applicable, in which the front surface 31*a* of the intermediate transfer belt 31 contacts the outer circumferential surface 36*a* of the secondary-transfer second roller 36 or the outer circumferential surface 404*a* of the secondary transfer belt 404 as the transfer device. This configuration prevents overcharge of toner, further preventing abnormal images.

According to the present embodiment, forming the prenip n2 prevents the electrical discharge. However, forming the prenip n2 leads to an increase in the total amount of a secondary transfer nip N, which causes a transfer current to laterally flow along the surface of the recording sheet P toward the secondary-transfer second roller 36 that is electrically grounded. This may overcharge toner, resulting in a degradation of transferability (a transfer failure) during the secondary transfer. The intermediate transfer belt 31 as a belt-shaped image bearer having multiple layers causes the similar spread of the secondary transfer current, thereby hampering the secondary transferability.

Therefore, in the present embodiment, the power source 39 applies a superimposed bias, in which an alternating current (AC) voltage, that is, an alternating current (AC) component is superimposed on a direct current (DC) voltage, that is, a direct current (DC) component, to a secondary-transfer first roller 33, as a secondary transfer bias. The power source 39 further applies the secondary transfer bias having a waveform with a high duty greater than 50%. Thus, while applying the transfer-directional peak voltage Vt to transfer toner onto the recording sheet P, the power source 39 applies the voltage smaller than the peak voltage Vt or the peak voltage Vr having an opposite polarity from that of the peak voltage Vt for a longer period of time than the peak voltage Vt does. This configuration prevents the toner from being overcharged while the toner image passes through the secondary transfer nip N.

In the embodiments described above, a description was provided of an image forming apparatus that employs the intermediate transfer method by which an image is transferred from the intermediate transfer belt 31 onto the recording sheet P. The configuration according to the present embodiments is applicable to image forming apparatuses that employ a direct transfer method in which an image is transferred from an image bearer, such as a photoconductive drum and a photoconductive belt, onto the recording sheet P. In addition, a transfer device that employs a charging method in which no transfer nip is formed may be used.

In the image forming apparatus according to the present embodiments described above, the recording sheet P passes through the secondary transfer nip N (the transfer portion) in a horizontal direction. Alternatively, in some embodiments, the image forming apparatus includes a configuration in which the recording sheet P passes through the transfer portion upward, downward, obliquely upward, or obliquely downward.

Although the embodiments of the present disclosure have been described above, the present disclosure is not limited to the embodiments described above, but a variety of modifications can naturally be made within the scope of the present disclosure.

The image forming apparatus of the present disclosure is not limited to a printer. The image forming apparatus includes, but is not limited to, a copier, a printer, a facsimile machine, and a multi-functional system including a combination thereof.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

an image bearer to bear a toner image;

a transfer device contacting the image bearer to form a transfer portion; and a transfer bias power source to output a transfer bias to transfer the toner image from the image bearer to a recording medium at the transfer portion, the transfer bias being a superimposed bias including a direct current (DC) component and an alternating current (AC) component that cyclically alternates between a transfer-directional bias to transfer the toner image from the image bearer to the recording medium and an opposite-directional bias in an opposite direction of the transfer direction, a controller to control the transfer bias power source to output the transfer bias, wherein a ratio of a time period of application of the opposite-directional bias to a total time period of one cycle of the AC component of the superimposed bias is greater than 50%, wherein a ratio of a value of the DC component of the superimposed bias output within a region ranging from a leading end of the recording medium to a predetermined length to a value of the DC component of the superimposed bias output outside the region is greater than a ratio of a value of the AC component of the superimposed bias output within the region to a value of the AC component of the superimposed bias output outside the region.

2. The image forming apparatus according to claim 1, wherein the controller changes the predetermined length of the region in accordance with a thickness of the recording medium.

3. The image forming apparatus according to claim 1, wherein the controller increases the predetermined length of the region as the thickness of the recording medium increases.

4. The image forming apparatus according to claim 1, wherein the controller changes the value of the DC component of the superimposed bias output within the region ranging to the predetermined length, in accordance with the thickness of the recording medium.

5. The image forming apparatus according to claim 4, wherein the controller increases the value of the DC component of the superimposed bias output within the region as the thickness of the recording medium increases.

6. The image forming apparatus according to claim 1, wherein the controller changes the value of the DC component of the superimposed bias output within the region, in accordance with an environment condition of the image forming apparatus.

7. The image forming apparatus according to claim 6, wherein the environment condition includes temperature and humidity, and wherein the controller increases the value of the DC component of the superimposed bias output within the region as the temperature and humidity decrease.

8. The image forming apparatus according to claim 1, wherein the image bearer is an intermediate transferor having an elastic layer.

9. The image forming apparatus according to claim 1, wherein the transfer device is a secondary transfer belt disposed in contact with the image bearer and rotatably wound around a plurality of rollers.

10. The image forming apparatus according to claim 1, further comprising an opposed roller opposing the transfer device via the image bearer in the transfer portion.

* * * * *